US006610189B2

(12) United States Patent
Wang et al.

(10) Patent No.: US 6,610,189 B2
(45) Date of Patent: Aug. 26, 2003

(54) METHOD AND ASSOCIATED APPARATUS TO MECHANICALLY ENHANCE THE DEPOSITION OF A METAL FILM WITHIN A FEATURE

(75) Inventors: Hougong Wang, Pleasanton, CA (US); Bo Zheng, San Jose, CA (US); Girish Dixit, San Jose, CA (US); Fusen Chen, Saratoga, CA (US)

(73) Assignee: Applied Materials, Inc., Santa Clara, CA (US)

( * ) Notice: Subject to any disclaimer, the term of this patent is extended or adjusted under 35 U.S.C. 154(b) by 86 days.

(21) Appl. No.: 09/754,499

(22) Filed: Jan. 3, 2001

(65) Prior Publication Data

US 2002/0084189 A1 Jul. 4, 2002

(51) Int. Cl.[7] ..... C25D 5/00; C25D 21/06; C25D 5/20; C25D 17/00; C25B 9/00

(52) U.S. Cl. ..... 205/88; 205/98; 205/148; 204/222; 204/273

(58) Field of Search ..... 204/222, 273; 205/88, 98, 148

(56) References Cited

U.S. PATENT DOCUMENTS

| | | | | |
|---|---|---|---|---|
| 2,742,413 A | | 4/1956 | Cransberg et al. | 204/52 |
| 2,882,209 A | | 4/1959 | Brown et al. | 204/52 |
| 3,727,620 A | | 4/1973 | Orr | 134/95 |
| 3,770,598 A | | 11/1973 | Creutz | 204/52 R |
| 3,919,061 A | * | 11/1975 | Jumer | 204/212 |
| 4,027,686 A | | 6/1977 | Shortes et al. | 134/33 |
| 4,092,176 A | | 5/1978 | Kozai et al. | 134/186 |

(List continued on next page.)

FOREIGN PATENT DOCUMENTS

| | | | |
|---|---|---|---|
| DE | 932 709 | 8/1952 | 48/607 |
| SU | 443 108 | 9/1974 | C23B/5/20 |

OTHER PUBLICATIONS

Laurell Technologies Corporation. "Two control configurations available—*see WS 400 or WS–400Lite*", dated Oct. 19, 1998.

Singer, P.,: Tantalum, Copper & Damascene: The Future of Interconnects:, *Semiconductor International* (Jun. 1998), pp. 91–92, 94, 96, & 98.

Singer, P., "Wafer Processing", *Semiconductor International* (Jun. 1998), p. 70.

Colombo, L., "Wafer Back Surface Film Removal", Central R&D, SGS–Thompson, Microelectronics, Agrate, Italy (No Date).

Semitool, Inc., "Metallization & Interconnect" (1998) (No Month).

Verteq Online, "Products Overview", (1998) (No Month).

Search Report for EPO Application No. 98309351.9, dated Aug. 26, 1999.

*Primary Examiner*—Donald R. Valentine
(74) *Attorney, Agent, or Firm*—Moser, Patterson & Sheridan

(57) ABSTRACT

A method and associated apparatus of electroplating an object and filling small features. The method comprises immersing the plating surface into an electrolyte solution and mechanically enhancing the concentration of metal ions in the electrolyte solution in the features. In one embodiment, the mechanical enhancement comprises mechanically vibrating the plating surface. In another embodiment, the mechanical enhancement comprises mechanically vibrating the electrolyte solution. In a further embodiment, the mechanical enhancement comprises increasing the pressure applied to the electrolyte solution.

22 Claims, 12 Drawing Sheets

U.S. PATENT DOCUMENTS

| | | | | |
|---|---|---|---|---|
| 4,110,176 | A | | 8/1978 | Creutz et al. ..... 204/52 R |
| 4,113,492 | A | | 9/1978 | Sato et al. ..... 96/67 |
| 4,315,059 | A | | 2/1982 | Raistrick et al. ..... 429/112 |
| 4,336,114 | A | | 6/1982 | Mayer et al. ..... 204/52 R |
| 4,376,685 | A | | 3/1983 | Watson ..... 204/52 R |
| 4,405,416 | A | | 9/1983 | Raistrick et al. ..... 204/68 |
| 4,489,740 | A | | 12/1984 | Rattan et al. ..... 134/140 |
| 4,510,176 | A | | 4/1985 | Cuthbert et al. ..... 427/82 |
| 4,518,678 | A | | 5/1985 | Allen ..... 430/311 |
| 4,519,846 | A | | 5/1985 | Aigo ..... 134/15 |
| 4,693,805 | A | | 9/1987 | Quazi ..... 204/192.22 |
| 4,732,785 | A | | 3/1988 | Brewer ..... 427/240 |
| 5,039,381 | A | | 8/1991 | Mullarkey ..... 204/47.5 |
| 5,055,425 | A | | 10/1991 | Leibovitz et al. ..... 437/195 |
| 5,155,336 | A | | 10/1992 | Gronet et al. ..... 219/411 |
| 5,162,260 | A | | 11/1992 | Leibovitz et al. ..... 437/195 |
| 5,222,310 | A | | 6/1993 | Thompson et al. ..... 34/202 |
| 5,224,504 | A | | 7/1993 | Thompson et al. ..... 134/155 |
| 5,230,743 | A | | 7/1993 | Thompson et al. ..... 134/32 |
| 5,252,807 | A | | 10/1993 | Chizinsky ..... 219/390 |
| 5,256,274 | A | | 10/1993 | Poris ..... 205/123 |
| 5,259,407 | A | | 11/1993 | Tuchida et al. ..... 134/151 |
| 5,290,361 | A | | 3/1994 | Hayashida et al. ..... 134/2 |
| 5,316,974 | A | | 5/1994 | Crank ..... 437/190 |
| 5,328,589 | A | | 7/1994 | Martin ..... 205/296 |
| 5,348,637 | A | * | 9/1994 | Kobayashi et al. ..... 204/213 |
| 5,349,978 | A | | 9/1994 | Sago et al. ..... 134/153 |
| 5,368,711 | A | | 11/1994 | Poris ..... 204/193 |
| 5,377,708 | A | | 1/1995 | Bergman et al. ..... 134/105 |
| 5,427,674 | A | * | 6/1995 | Langenskiöld et al. ..... 205/88 |
| 5,429,733 | A | | 7/1995 | Ishida ..... 204/224 R |
| 5,431,801 | A | * | 7/1995 | Nishimura et al. ..... 205/88 |
| 5,454,930 | A | | 10/1995 | Miura et al. ..... 205/159 |
| 5,608,943 | A | | 3/1997 | Konishi et al. ..... 15/302 |
| 5,625,170 | A | | 4/1997 | Poris ..... 177/50 |
| 5,651,865 | A | | 7/1997 | Sellers ..... 204/192.13 |
| 5,705,223 | A | | 1/1998 | Bunkofske ..... 427/240 |
| 5,718,813 | A | | 2/1998 | Drummond et al. ... 204/192.12 |
| 5,723,028 | A | | 3/1998 | Poris ..... 204/231 |
| 6,113,771 | A | | 9/2000 | Landau et al. ..... 205/123 |
| 6,261,433 | B1 | * | 7/2001 | Landau ..... 205/96 |
| 6,319,384 | B1 | * | 11/2001 | Taylor et al. ..... 205/103 |
| 6,368,482 | B1 | * | 4/2002 | Oeftering et al. ..... 205/91 |
| 6,368,484 | B1 | * | 4/2002 | Volant et al. ..... 205/220 |
| 6,416,647 | B1 | * | 7/2002 | Dordi et al. ..... 205/137 |

* cited by examiner

METHOD AND ASSOCIATED APPARATUS TO MECHANICALLY ENHANCE THE DEPOSITION OF A METAL FILM WITHIN A FEATURE

BACKGROUND OF THE DISCLOSURE

1. Field of the Invention

The invention relates to metal film deposition. More particularly, the invention relates to enhancing deposition of a metal film within a feature on a substrate.

2. Description of the Background Art

As circuit densities increase, the widths of features, such as vias, trenches, and electric contacts, as well as the width of the dielectric materials between these features, decrease. However, the height of the dielectric layers remains substantially constant. Therefore, the aspect ratios of the features, i.e., the features height or depth divided by its width, increases. The concurrent reduction of width and increase in aspect ratio of the features poses a challenge to traditional metal film deposition techniques and processes because reliable formation of interconnect features are required to increase circuit density, to permit greater power density endured by interconnect features, and to improve the quality of individually processed substrates.

Electroplating, previously limited in integrated circuit design to the fabrication of lines on circuit boards, is now being used to deposit metal films, such as copper, within features formed in substrates. Electroplating, in general, can be performed using a variety of techniques. One embodiment of an electroplating metal film deposition process involves initially depositing a diffusion barrier layer over the feature surface by a process such as physical vapor deposition (PVD) or chemical vapor deposition (CVD). A seed layer is then deposited on the substrate over the diffusion barrier layer by PVD or CVD. Finally, the metal film is deposited on the seed layer by electroplating. The metal film layer can be planarized by a process such as chemical mechanical polishing (CMP) to define conductive interconnect features.

Deposition of the metal film during electroplating is accomplished by providing an electric current between the seed layer on the substrate and a separate anode. Both the anode and the substrate seed layer are immersed in an electrolyte solution containing metal ions that are to be deposited on to the seed layer. The anode also generates metal ions in the electrolyte solution. FIGS. 2A and 2B show cross sectional views of the progression of a deposited metal film, such as copper, within a single feature 202 on substrate 200 that is representative of all of the features formed on the seed layer. FIG. 2A shows a substrate having undergone PVD or CVD processing in which a seed layer 220 has been deposited on all the surfaces of feature 202 including the horizontal field 204, the walls 206, and the bottom 208. FIG. 2B shows the substrate 200 having an electroplated metal film 215 deposited on the seed layer 220. To provide uniform electric characteristics, it is important to deposit a substantially even metal film 215 on those portions of the seed layer 220 that extend over the horizontal field 204. It is also important to deposit a metal film that completely fills the feature 202 without any voids or air gaps in the feature.

As the dimensions of the features decrease below submicron dimensions, the dynamics associated with supplying metal ions within the electrolyte solution into the features becomes difficult to control. Due to the small opening (e.g., throat of the feature), one of the technical challenges involves depositing more metal ions into the features through the throat to form the metal film. Ion starvation resulting from the concentration of the metal ions supplied into the features to replace the metal ions that leave deposited as metal film in the features is limited. As such, the concentration of metal ions in the electrolyte solution contained within the features requires rejuvenation. "Ion-starvation", as shown in FIG. 2B, often occurs during plating of features having a small dimension (i.e. less than 1 $\mu$m) in which insufficient metal ions are supplied to within the feature to limit the concentration of metal ions in the feature. Because of ion-starvation in the feature, the metal film deposition rate at the throat of the channel 212 exceeds the metal film deposition rate on the walls 206 or bottom 208 of the feature, and frequently creates a void 214 within the feature 202. Completely filling the features 202 with metal film is difficult because of the minute size of the features, because the features are oriented at different angles, and because an increased charge density causes more deposition at the edges and corners (i.e. at throat 212) of the features. An overhang of the seed layer 220 also leads to the void 214. The electrical characteristics of features having a void is unpredictable, and parts having features formed with voids are not suitable for use in a reliable electronic device.

It is desirable to use high metal film deposition rates, within the features and in the field surrounding the features, both for higher processing throughput and for increased utilization of the associated processing equipment. The deposition rates are largely a function of the bias voltage applied to the substrate. However, if the initial bias voltage applied to the substrate is too high, there is an increased tendency to choke off the feature at throat 212. Therefore, the initial bias voltage in present electroplating systems is often reduced to approximately 0.8 volts until such times that the features have started to fill.

In a so-called "bottom-up" electromagnetic field that is applied through the electrolyte solution between an anode and a seed layer during a bottom-up deposition process, the current density and the associated metal film deposition rate on of the bottom 208 exceeds that on the horizontal field 204 or the walls 206. The goal of bottom-up deposition is to completely fill a feature with metal film yielding a substrate 200 having filled features. After the feature is completely filled, all further metal film deposition will increase the depth of the horizontal field 204.

Such bottom-up deposition processes are difficult to achieve in practice minute size features (in the sub-micron range). During plating in features having small dimensions, it is make it difficult to replace metal ions in the electrolyte solution that are deposited during the plating, to maintain a sufficient metal ion concentration within the electrolyte solution in the feature. As the metal ions are deposited on the surfaces of the features as metal film, the concentration of metal ions remaining in the electrolyte solution within the feature decreases. Maintaining the concentration of metal ions in the electrolyte solution within the feature is therefore important during the metal deposition process to provide the desired deposition rate of metal film within the features.

One technique for minimizing deposits that close off a throat 212 before the remainder if the feature is filled is to apply an alternative series of deposition and etch steps, i.e. dep-etch steps. Each deposit portion of the cycle deposits metal ions from the electrolyte solution into the features 202 and on to the horizontal field 204, while, unfortunately, also creating buildup at throat 212. Each etch cycle then partially etches the metal film in the horizontal field 204 on the substrate to keep the throat open. The deposits forming on the wall 206 and the bottom 208 are etched at a lower rate, during the etch cycle, than those on the horizontal field 204 as a result of the minute size of the features. However, the dep-etch technique is time consuming and substantially reduces throughput of substrates.

Therefore, there remains a need for an ECP system that enhances the concentration of metal ions contained in the electrolyte solution within the features and increases the deposition rate within those features, resulting in improved overall processing throughput.

SUMMARY OF THE INVENTION

In one aspect, a method and associated apparatus of electroplating an object that has small features is provided. The method comprises immersing the plating surface into an electrolyte solution and mechanically enhancing the concentration of metal ions in the electrolyte solution contained in the features. In one embodiment, the mechanical enhancement comprises mechanically vibrating the plating surface. In another embodiment, the mechanical enhancement comprises mechanically vibrating the electrolyte solution. In a further embodiment, the mechanical enhancement comprises increasing the pressure applied to the electrolyte solution.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate elements that are common to the figures.

DETAILED DESCRIPTION OF THE PREFERRED EMBODIMENT

After considering the following description, those skilled in the art will clearly realize that the teachings of this invention can be readily utilized in metal film deposition applications, and more particularly to methods of enhancing the deposition rate of a metal film on a seed layer formed on horizontal fields and within features formed in a substrate 200.

In this disclosure, the term "enhancing" the concentration of metal ions in the feature refers to increasing or rejuvenating the depleted concentration of metal ions in the feature, or otherwise increasing the concentration of metal ions in the feature to a level that approaches, equals, or exceeds the concentration of metal ions in the electrolyte solution outside the opening of the feature.

Enhancing the concentration of copper ions within the electrolyte solution that is contained within the small features during the initial phases of metal ion deposition improves the metal film deposition within the features, improves bottom-up deposition integrity, and limits the generation of voids, i.e. spaces, being formed within the features.

Figure 1:
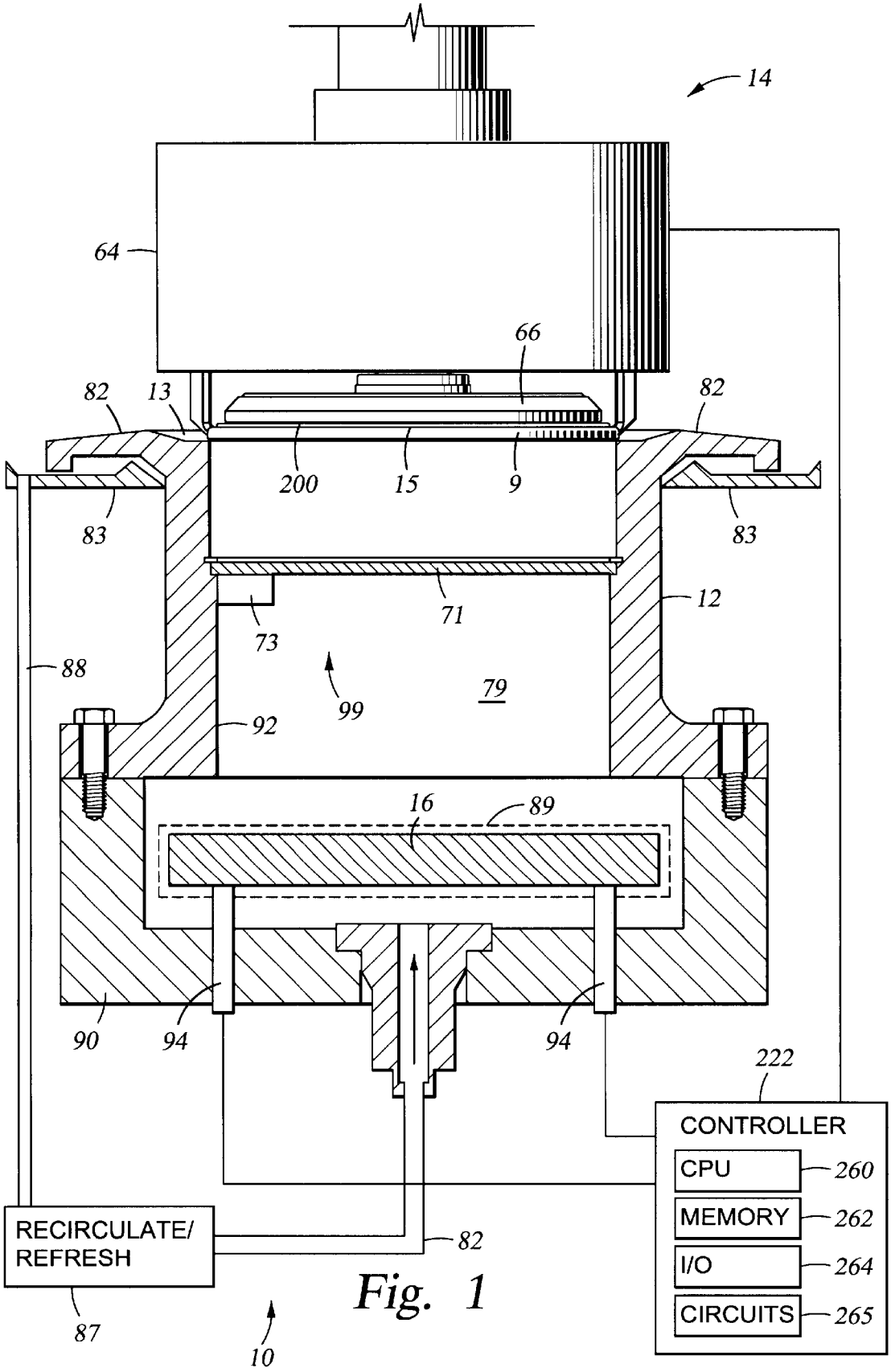
FIG. 1 shows a side cross sectional view of an electrochemical plating (ECP) device, including one embodiment of a vibratory inducement device.

Several embodiments are described in this disclosure in which the concentration of metal ions in the electrolyte solution contained in the features is enhanced by either applying relative vibration between the electrolyte solution and the substrate 200 or by applying pressure to the electrolyte solution. To provide an adequate background or these embodiments, a metal film deposition process using an electrochemical deposition (ECP) system, i.e. as 10 in FIG. 1, is described. A substrate holder system including a head assembly contained within the ECP device, and the operation of the substrate older system is then described. The embodiments of vibrational and pressure-based devices that enhance the concentration of the metal ions within the electrolyte solution contained in the features are then described.

1. Electroplating Cell Configuration

FIG. 1 illustrates one embodiment of an ECP system 10 that enhances metal film deposition on the seed layer formed in the features 202 and on the horizontal fields 204. The ECP System 10 includes a process cell or electrolyte cell 12 having an upper opening 13, a removable substrate holder system 14 that secures a substrate 200 in such a manner that the substrate 200 can be pivoted into and away from the electrolyte cell 12, and an anode 16 mounted near the bottom portion of the electrolyte cell 12.

The substrate holder system 14 shown in FIG. 1 is simplified for ease of display. One embodiment of the substrate holder system 14 includes a head portion 64 that can hold and rotate a substrate 200 when the substrate is immersed in the electrolyte solution contained in the electrolyte cell 12. The head portion assembly 64 can be displaced vertically, and angled to position the substrate 200 in a desired attitude to assist in the loading and unloading of the substrate 200 into the ECP System 10. The head portion 64 may provide additional movement, such as rotational movement of the substrate, during the processing and/or the drying of the substrates. The substrate holder system 14 is pivotably mounted above the upper opening in a manner suitable for either the substrate 200 immersion or removal. The head portion can also be displaced to a position where substrates can be loaded or unloaded by a robot.

In one embodiment, controller 222 controls the electric current/voltage supplied to the anode 16 and a contact ring 9. The contact ring 9 is adapted to contact a seed layer formed on a substrate 200 that has been loaded in the head portion. In a simplified embodiment, a power supply can be used instead of the controller 222, and the power supply can be manually operated by a skilled operator.

Although a semiconductor substrate is disclosed herein as the object being electroplated, it is envisioned that different embodiments of the system can be used to deposite metal ions on any substrate, object, or wafer having features formed on a plating surface and/or seed layer. In this disclosure, the term "ECP" is intended to be applied to any system in which a metal film is deposited on a surface under the effect of an electromagnetic field.

The electrolyte cell 12 comprises an anode base 90 and an upper electrolyte cell 92. The anode 16 is mounted to the anode base 90 by anode supports 94. One or more feed throughs, that may be contained in the anode supports, supply electrical power to the anode. Alternatively, the sides of the anode may be mounted to the interior sides of the electrolyte cell 12. The upper electrolyte cell 92 is configured to ensure that electric flux lines extending from the anode are substantially perpendicular to the substrate 200. The substantially perpendicular electric flux lines thus enhance the uniformity of the metal ion deposition across the seed layer on the substrate 200. The upper electrolyte cell 92 is removably attached to anode base 90 by fasteners, and the upper electrolyte cell 92 can be removed for anode replacement and/or repair.

The electrolyte solution carries the metallic ions generated by the anode 16 to the seed layer on the substrate 200. The flow of metal ions within the electrolyte solution extends up to the cathode, and some of the metal ions flow around the cathode. A hydrophilic membrane 89 may be fashioned as a bag to surround the anode 16 that is closed around the anode except for the various pipes or connectors that connect to the anode. Alternatively, the hydrophilic membrane could be mounted to extend horizontally across the electrolyte cell 12 above the anode in which the hydrophilic membrance extends around, e.g., a bracket that conforms to, and is removably secured to, the inner periphery of the electrolyte cell. The reaction of the electrolyte solution with the anode results in the generation of metal ions into the electrolyte. The material of the hydrophilic membrane 89 is selected to filter any particles or unwanted material dislodged from the anode 16 into the electrolyte solution, while permitting metal ions, such as copper, generated by anode 16 to pass from the anode 16 to the substrate 200.

Electrolyte solution is supplied to electrolyte cell 12 via electrolyte input port 80. The displaced electrolyte solution in the electrolyte cell 12 overflows the annular lip 82 into a catch drain 83, that in turn drains into electrolyte output 88 that is fluidly coupled to a recirculation/refreshing element 87. The recirculation/refreshing element 87 recirculates the electrolyte solution contained in the electrolyte cell 12 that has been discharged to the electrolyte output 88 and refreshes the chemicals contained within the electrolyte solution. The use of refreshed electrolyte solution ensures that sufficient chemicals are contained within the electrolyte solution to perform the metal film deposition process. In this disclosure, the term "seed layer" is used interchangeably with the term "plating surface" as those surfaces on the substrate on which the metal ions deposit. If there is no recirculation within the electrolyte cell 12, eventually the depletion region will expand until no copper ions are within sufficient distance to be attracted to the seed layer. The refreshed electrolyte solution input at electrolyte inlet port 80 provides a generally upward flow of electrolyte solution within the electrolyte cell 12 that overflows the annular lip 82.

One embodiment of the chemical reactions that occur in the embodiment of ECP system shown in FIG. 1 may be subdivided into whether a positive bias is applied between the anode and the seed layer to effect plating metal film on the substrate, or whether a negative bias is applied between the anode and the seed layer to effect deplating metal film on the substrate. An ECP system 10 is shown in U.S. patent application Ser. No. 09/289,074, filed Apr. 8, 1999, now U.S. Pat. No. 6,258,220, and entitled "ELECTROCHEMICAL DEPOSITION SYSTEM" (incorporated herein by reference in its entirety). If a sufficient positive bias is being applied so the voltage of the seed layer is below the voltage of the anode to effect plating on the substrate the following exemplary chemical reactions occur:

Anode chemical reaction $$2H_2O \rightarrow O_2 + 4H^{30} + 4e^-$$

Cathode (seed layer) chemical reaction $$Cu^{++} + 2e^- \rightarrow Cu$$

If a sufficient negative bias is applied so the voltage of the seed layer exceeds the voltage of the anode by a sufficient level to effect deplating copper from the seed layer, the following exemplary chemical reactions occur:

Anode chemical reaction $$Cu \rightarrow Cu^{++} + 2e^-$$

Cathode (seed layer) chemical reaction $$Cu^{++} + 2e^- \rightarrow Cu$$

The refreshed electrolyte solution output from the recirculation/refreshing element 87 is applied to the inlet port 80 to define a closed loop that supplies and recirculates the electrolyte solution contained within the electrolyte cell 12.

The controller 222 shown in the embodiment of FIG. 1 controls electric voltage and/or current supplied to the anode 16 and the plating surface of the substrate/cathode 200. The controller 222 comprises a central processing unit (CPU) 260, a memory 262, a circuit portion 265, an input output interface (I/O) 264, and a bus, that is not shown. The controller 222 may be a general-purpose computer, a microprocessor, a microcontroller, or any other known suitable type of computer or controller. The CPU 260 performs the processing and arithmetic operations for the controller 222, and controls the operation of the voltage applied to the anode 16, the plating surface 15 of the substrate 200, and the operation of the substrate holder system 14.

The memory 262 includes random access memory (RAM) and read only memory (ROM) that together store the computer programs, operands, operators, dimensional values, system processing temperatures and configurations, and other parameters that control the electroplating operation. The bus, not shown, provides for digital information transmissions between CPU 260, circuit portion 265, memory 262, and I/O 264. The bus also connects I/O 264 to the portions of the ECP system 10 that either receive digital information from, or transmit digital information to, controller 222.

I/O 264 provides an interface to control the transmissions of digital information between each of the components in controller 222. Circuit portion 265 comprises all of the other user interface devices, such as display and keyboard, system devices, and other accessories associated with the controller 222. While one embodiment of digital controller 222 is described herein, other embodiments of digital controllers, as well as analog controllers, could function well in this application, and are within the intended scope of the invention.

2. Substrate Support Assembly

Figure 3A:
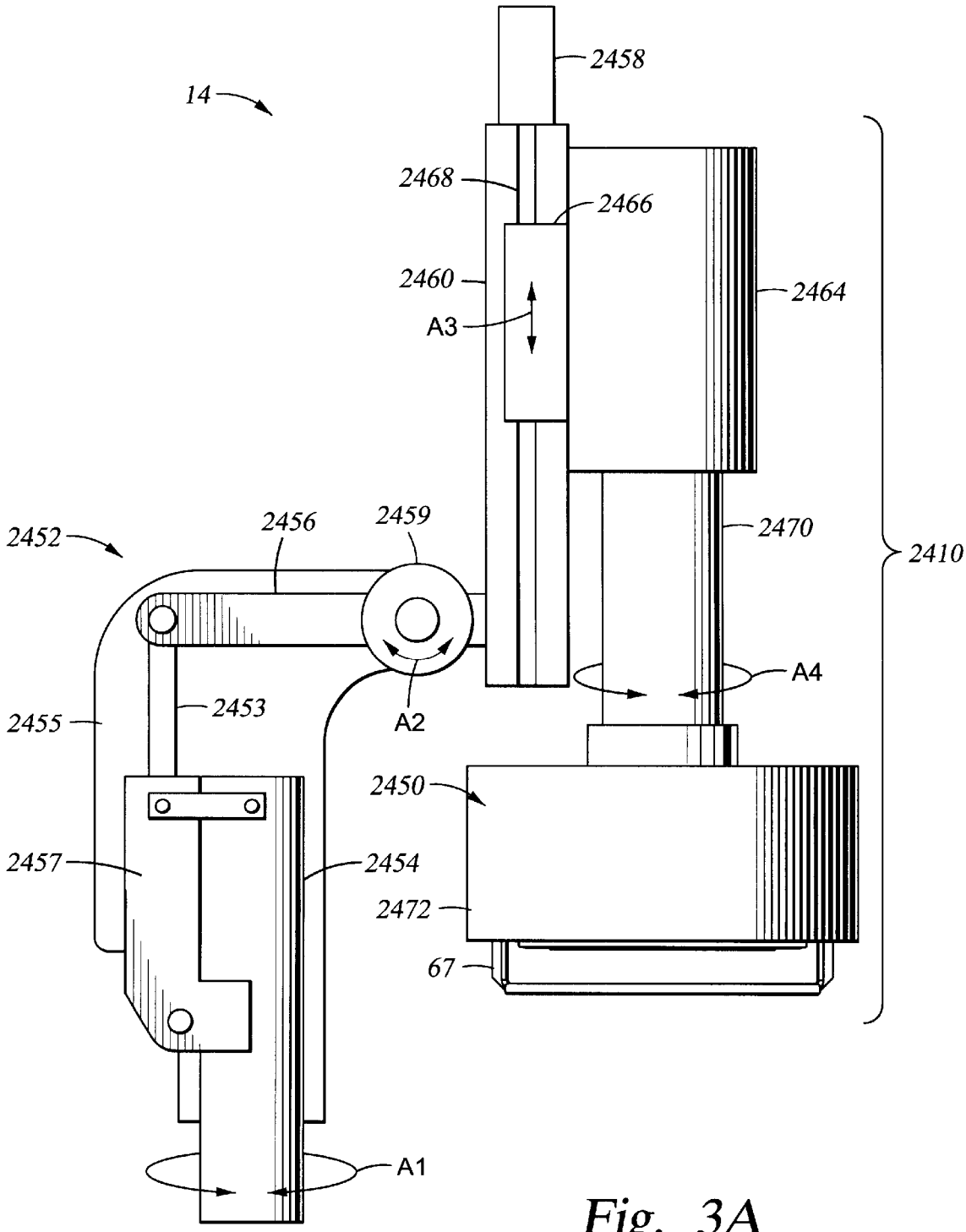
FIG. 3A shows a side cross-sectional view of one embodiment of a substrate holder system associated with the FIG. 1 ECP device.

FIG. 3A is a partial cross sectional view of one embodiment of a substrate holder system 14 that is capable of translating a substrate holder assembly 2450 in the horizontal and vertical directions. The embodiment of a substrate holder system 14 shown in FIG. 3A also provides for tilting of the substrate at an angle α from horizontal in addition to translation in horizontal and a vertical directions. This embodiment of substrate holder assembly provides for rotation of the substrate during immersion of the substrate into the electrolyte solution where the substrate is held by the substrate holder assembly 2450. The substrate holder system 14 includes a rotatable head assembly 2410 and a head assembly frame 2452. The head assembly frame 2452 includes a mounting post 2454, a shaft 2453, a post cover 2455, a cantilever arm 2456, a cantilever arm actuator 2457, and a pivot joint 2459. The mounting post 2454 is mounted onto the body of the mainframe, and the post cover 2455 covers a top portion of the mounting post 2454.

In one embodiment, the mounting post 2454 provides rotational movement, in a direction indicated by arrow A1, to allow for rotation of the head assembly frame 2452 about a substantially vertical axis which extends through the mounting post 2454. Such motion is generally provided to align the head assembly 2410 with the electrolyte cell.

One end of the cantilever arm 2456 is pivotally connected to the shaft 2453 of the cantilever arm actuator 2457. The cantilever arm actuator 2457 is, for example, a pneumatic cylinder, a lead-screw actuator, a servo-motor, or other type actuator. The cantilever arm 2456 is pivotally connected to the mounting slide 2460 at the pivot joint 2459. The cantilever arm actuator 2457 is mounted to the mounting post 2454. The pivot joint 2459 is rotatably mounted to the post cover 2455 so that the cantilever arm 2456 can pivot about the post cover at the pivot joint. Actuation of the cantilever arm actuator 2457 provides pivotal movement, in a direction indicated by arrow A2, of the cantilever arm 2456 about the pivot joint 2459. Alternatively, a rotary motor may be provided as a cantilever arm actuator 2457, wherein output of a rotary motor is connected directly between the post cover 2455 and the pivot joint 2459. The rotary motor output effects rotation of the cantilever arm 2456 and the head assembly 2410 about the pivot joint.

The rotatable head assembly 2410 is attached to a mounting slide 2460 of the head assembly frame 2452, and the mounting slide 2460 is disposed at the distal end of the cantilever arm 2456. Rotation of the rotatable head assembly 2410 about the pivot joint 2459 causes tilting of a substrate held within the substrate holder assembly 2450 of the rotatable head assembly 2410 about the pivot joint 2459 relative to horizontal. When the cantilever arm actuator 2457 is retracted, the cantilever arm 2456 raises the head assembly 2410 away from the electrolyte cell 12.

Tilting of the rotatable head assembly 2410 affects tilting of the substrate relative to the electrolyte cell 12. When the cantilever arm actuator 2457 is extended, the cantilever arm 2456 moves the head assembly 2410 toward the electrolyte cell 12 to angle the substrate closer to horizontal. In one embodiment, the substrate is in a substantially horizontal position during ECP.

The rotatable head assembly 2410 includes a rotating actuator 2464 slidably connected to the mounting slide 2460. The mounting slide 2460 guides the vertical motion of the rotatable head assembly 2410. A head lift actuator 2458 is disposed on the mounting slide 2460 to provide motive force for vertical displacement of the head assembly 2410. The shaft 2468 of the head lift actuator 2458 is inserted through a lift guide 2466 attached to the body of the rotating actuator 2464. In one embodiment, the shaft 2468 is a lead-screw type shaft that moves the lift guide in a direction indicated by arrow A3, between various vertical positions. This lifting of the rotatable head assembly 2410 can be used to remove and/or replace the substrate holder assembly 2450 from the electrolyte cell 12. Removing the substrate from the process cell is necessary to position the substrate so that a robot can remove the substrate from the rotatable head assembly 2410.

The rotating actuator 2464 is connected to the substrate holder assembly 2450 through the shaft 2470 and rotates the substrate holder assembly 2450 in a direction indicated by arrow A4. Rotation of the substrate during the electroplating process generally enhances the deposition results. In one embodiment, the head assembly rotates the substrate about the vertical axis of the substrate between about 0 RPM and about 200 RPM, and preferably between about 10 and about 40 RPM, during the electroplating process. Rotation of the substrate at a higher angular velocity may result in turbulence within the electrolyte solution. The head assembly can also be rotated as the head assembly is lowered to position the substrate in contact with the electrolyte solution, as well as when the head assembly is raised to remove the substrate from the electrolyte solution in the process cell. The head assembly can rotate at a high speed, e.g., up to about 2,500 RPM, after the head assembly is lifted from the process cell, following the removal from the electrolyte solution to enhance removal of residual electrolyte solution on the substrate utilizing the centrifugal force applied to the liquid on the substrate.

Figure 3B:
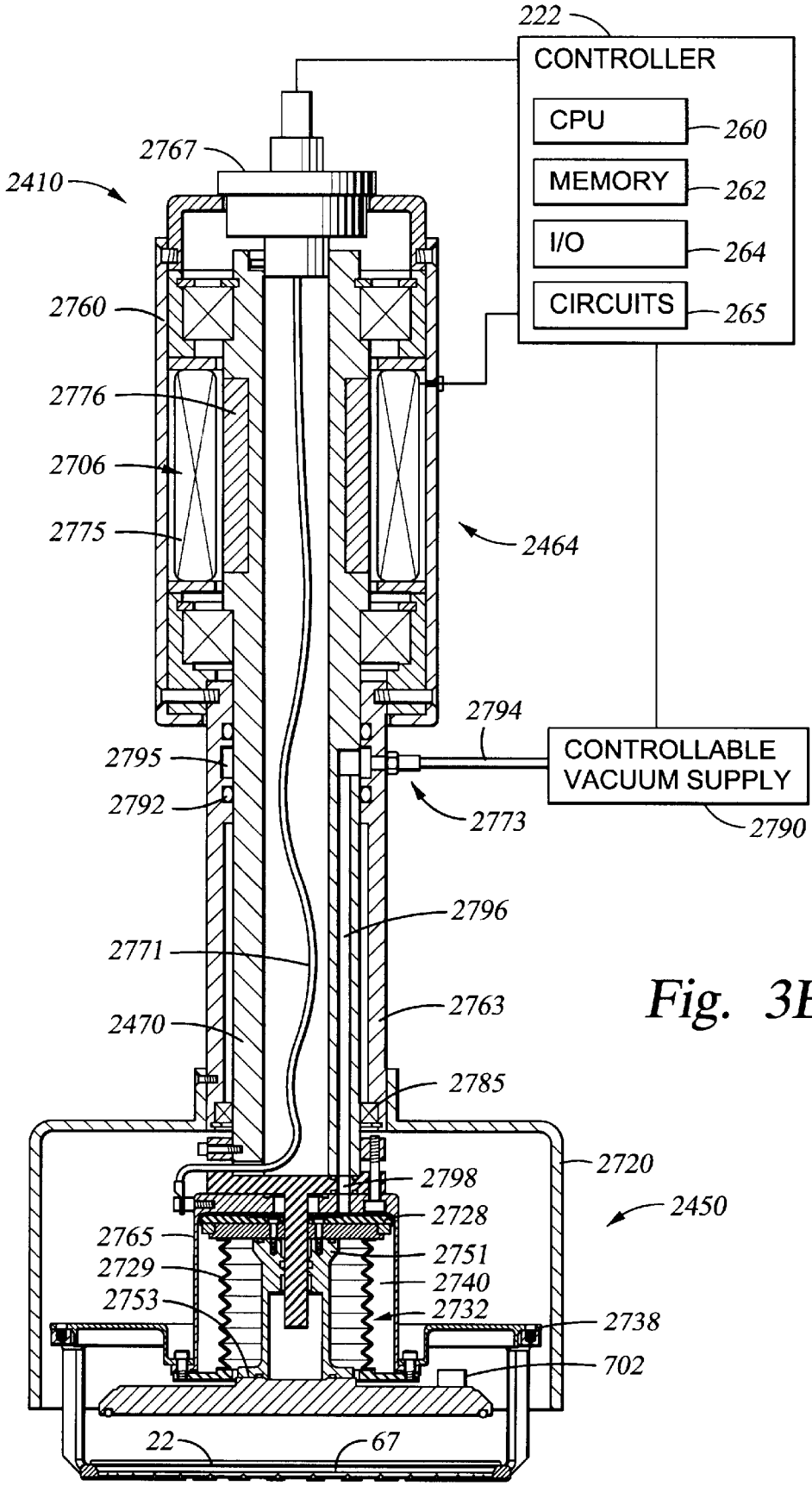
FIG. 3B shows a cross sectional view of the head assembly included in the substrate holder system of FIG. 3A.

FIG. 3B shows a cross sectional view of one embodiment of rotatable head assembly 2410 that can provide for the rotation of, and the rotation of, the substrate contained in the substrate holder system 14 of the embodiment shown in FIG. 3A. The rotatable head assembly 2410 allows for lowering of the thrust plate 66 to position a substrate in contact with the electric contact element 67. The thrust plate can also be raised to provide a space between the thrust plate 66 and the electric contact element 67 to permit removal of the substrate from, or insertion of the substrate into, the rotatable head assembly 2410. The rotatable head assembly 2410 comprises a substrate holder assembly 2450, a rotating actuator 2464, a shaft shield 2763, a shaft 2470, an electric feed through 2767, an electric conductor 2771, and a pneumatic feed through 2773. The rotating actuator 2464 comprises a head rotation housing 2760 and a head rotation motor 2706. The head rotation motor 2706 comprises a coil segment 2775 and a magnetic rotary element 2776. The hollow coil segment 2775 generates a magnetic field that rotates the magnetic rotary element 2776 about a vertical axis. The substrate holder assembly 2450 comprises a fluid shield 2720, a contact housing 2765 a thrust plate 66, an electric contact element 67, and a spring assembly 2732.

The contact housing 2765 and the spring assembly 2732 are generally annular, and these two elements are configured so rotational motion of one element is transferred to the other element, and may provide for a combined rotation that is transferred to the thrust plate 66 and the electric contact element 67. The spring assembly 2732 comprises an upper spring surface 2728, a spring bellow connector 2729, and a lower spring surface 2738. Seal element 2751 seals the fluid passage between the upper spring surface 2728 and the thrust plate 66. Seal element 2753 seals the fluid passage between the lower spring surface 2738 and the contact housing 2765.

Electricity is supplied to the electric contact element 67 that contacts the seed layer on a substrate to provide a desired voltage between the anode 16 and the substrate seed layer. Electricity is supplied from the controller 222 to the electric contact element 67 via the electric feed through 2767, a conductor 2771, and the contact housing 2765. The electric contact element 67 is disposed in physical and electrical contact with the seed layer on the substrate. The shaft 2470, the contact housing 2765, the spring assembly 2732, the thrust plate 66, the electric contact element 67, the rotary mount 2799, and the substrate 200 secured between the thrust plate 66 and the electric contact element 67 all rotate as a unit about a longitudinal axis of the head assembly 2410. The head rotation motor 2706 provides the motive force to rotate the above elements about its vertical axis.

A vacuum is controllably supplied to portions of the rotatable head assembly 2410 by the pneumatic feed through 2773 to control the position of the thrust plate relative to the electric contact element 67. The pneumatic feed through 2773 comprises a controllable vacuum supply 2790, a sleeve member 2792, a fluid conduit 2794, a circumferential groove 2795, a fluid aperture 2796, and a fluid passage 2798. The sleeve member 2792 may be a distinct member, or a portion of the shaft as shown in FIG. 3B. The circumferential groove 2795 extends within the sleeve member 2792 about the circumference of the shaft 2470. The pneumatic feed through supplies a vacuum to a pressure reservoir 2740. The pressure reservoir is configured to maintain either positive air pressure or vacuum, depending upon the configuration of the head assembly 2410. The fluid aperture 2796 is in fluid communication with the circumferential groove. The fluid aperture 2796 extends axially through the shaft 2470 from the circumferential groove 2795 to the bottom of the shaft 2470. The fluid passage 2798 extends through the contact housing 2765. The fluid aperture 2796 at the bottom of the shaft is in fluid communication with the fluid passage 2798. The inner surface of the sleeve member 2792 has a small clearance, e.g. about 0.0002 inch, with the outer surface of the shaft 2470 to allow relative rotation between these two members.

A vacuum is applied from the controllable vacuum supply 2790 via the fluid conduit 2794 to the inner surface of the sleeve member 2792 and the circumferential groove 2795. The vacuum is applied from the fluid aperture 2796 to the fluid passage 2798 and the pressure reservoir 2740. Due to the tight clearance between the sleeve member 2792 and the shaft 2470, a vacuum applied to the inner surface of the sleeve member 2792 passes via the circumferential groove 2795 to the fluid aperture 2796. The tight clearance limits air entering between the sleeve member 2792 and the outer surface of the shaft 2470. Therefore, the vacuum applied from the controllable vacuum supply 2790 extends to the pressure reservoir. A vacuum within the shaft 2470 passes through the fluid passage 2798 to a pressure reservoir 2740 formed between the spring assembly 2732 and the contact housing 2765. The vacuum applied by the controllable vacuum supply 2790 thereby controls the vacuum in the pressure reservoir 2740.

The spring bellow connector 2729 combines aspects of a spring and a bellows. The spring bellow connector 2729 is attached between the thrust plate 66 and the contact housing 2765. The spring bellows connector 2729 limits fluid flow between the thrust plate 66 and the electric contact element 67. The spring bellows connector 2729 additionally exerts a spring force when axially displaced, either compressed or extended, from its relaxed shape. The bias of the spring bellow connector 2729 is used to position the thrust plate 66 relative to the electric contact element 67. Any suitable type of bellows or baffle member that has a spring constant may be used as spring bellow connector 2729. Alternatively, separate spring and bellows members may be used as the spring bellow connector 2729. The upper spring surface 2728 is annular shaped and is sealably connected to the thrust plate 66. The lower spring surface 2738 is sealably connected to the contact housing 2765. A pressure reservoir 2740 is defined in the annulus between the contact housing 2765 and the spring assembly 2732. In one embodiment, the thrust plate is normally pressed against the backside of the substrate by the spring tension exerted by the spring bellow connector 2729. Application of the vacuum within the pressure chamber 2740 raises spring bellows connector 2729, and thereby also raises the thrust plate 66.

FIG. 3B shows an embodiment in which a vacuum supplied by the controllable vacuum supply 2790 applied to the pressure reservoir 2740 is provided to upwardly displace the upper spring surface 2728 of the spring assembly 2732. Alternatively, the spring assembly 2732 may be configured so pressure applied from a controllable pressure supply (that replaces the controllable vacuum supply 2790 in this latter embodiment) applied to the pressure reservoir displaces the upper spring surface 2728 of the spring assembly.

The thrust plate 66 is displaced to a raised position when a robot, not shown, is loading or unloading a substrate 200 onto the electric contact element 67. Following insertion by the robot, the substrate 200 rests upon the electric contact element such that the periphery of the substrate seed layer rests upon the contact element. The thrust plate 66 is then lowered firmly against the back surface of a substrate 200 to ensure a snug contact between the substrate seed layer and the electric contact element 67. The electric contact element 67 is arranged to be generally circular to extend proximate the periphery of the substrate, and support the substrate at these peripheral locations. Those seed layer locations on the substrate that are within the peripheral substrate locations that contact the circular electric contact element will contact the electrolyte solution when the substrate holder system 14 is immersed in the electrolyte solution. Electricity can be applied from the controller 2002 to the seed layer on the substrate 200 through the electric contact element 67.

The substrate holder assembly 2450 is configured to hold a substrate 200 in a secured position such that the substrate can be moved between the exchange, dry, and process positions. The thrust plate 66 can also be biased downwardly to secure substrate 200 against the electric contact element 67. The thrust plate 66 can be biased upwardly to provide a space between the thrust plate 66 and the electric contact element 67 through which a substrate can be inserted by a robot device. In the embodiment shown in FIG. 3B, upward bias to the thrust plate is provided by a vacuum created within pressure reservoir 2740 by the controllable vacuum supply 2790. The vacuum in the pressure reservoir 2740 causes the upper spring surface 2728, the remainder of the spring assembly 2732, and the attached thrust plate 66 to be displaced upwardly.

Reducing the vacuum from the controllable vacuum supply 2790 allows the spring bellow connector 2729 to return to its normal tensioned position by which the upper spring surface 2728 biases the attached thrust plate 66 into secure contact with substrate 200 positioned on the electric contact element 67. This physical biasing of the substrate against the electric contact element 67 is sufficient to enhance the electric contact between the electric contact element 67 and the seed layer on the substrate 200. The electric contact element 67 extends about the periphery of the seed layer on a substrate inserted in the substrate holder assembly, and is electrically biased relative to the anode 16 shown in the embodiment of FIG. 1 to effect metal film deposition on the seed layer. The thrust plate 66, the electric contact element 67, the spring bellow connector 2729, and a substrate inserted on the electric contact element all rotate relative to the fluid shield 2720. The fluid shield 2720 remains fixed to the shaft shield 2763 and does not rotate.

The head rotation motor 2706 is mounted within, and at least partially extends through, the inner circumference of the hollow head rotation housing 2760 and is connected to shaft 2470. The hollow coil segment 2775 is mounted to, and remains substantially stationary relative to, the inside of the hollow head rotation housing 2760. The shaft 2470 includes a magnet portion 2776 that can be rotated about a vertical axis. The magnet portion 2776 is physically disposed within the hollow portion of the hollow coil segment 2775. The hollow coil segment 2775 induces rotation in the magnet portion 2776 and the connected shaft 2470. Bearings 2785 are provided between shaft shield 2763 and the shaft 2470 to limit lateral travel of the shaft 2470 during rotation about a vertical axis. The output of the shaft 2470, at the lower end of the shaft, provides rotary motion to certain portions of the substrate holder assembly 2450 including a thrust plate 66 and a substrate 200 held between the thrust plate and the electric contact element 67, as described below. The head rotation motor 2706 may be of the type that produces output rotation in the range from, for example, 0 RPM to 2500 RPM as controlled by the controller 2002.

The fluid shield 2720 is optional and may be disposed about the periphery of, and preferably spaced from, the substrate holder assembly 2450. The fluid shield contains electrolyte solution or other matter that may be removed from the substrate or substrate holder assembly by centrifugal rotation of the substrate holder assembly 2450 on other adjacent equipment.

The substrate holder assembly 2450 functions to position the substrate seed layer relative to the electrolyte solution during start-up, processing, and removal of the substrate. The operation of the substrate holder system 14 is controlled by the controller 222. The controlled operations include the application of a vacuum to pressure reservoir 2740 to extend or retract the thrust plate 66, the operation and angular velocity of the motor 2706, the position of the pivot joint 2459 that controls the tilt of the substrate, and other such mechanical displacements.

Figure 7:
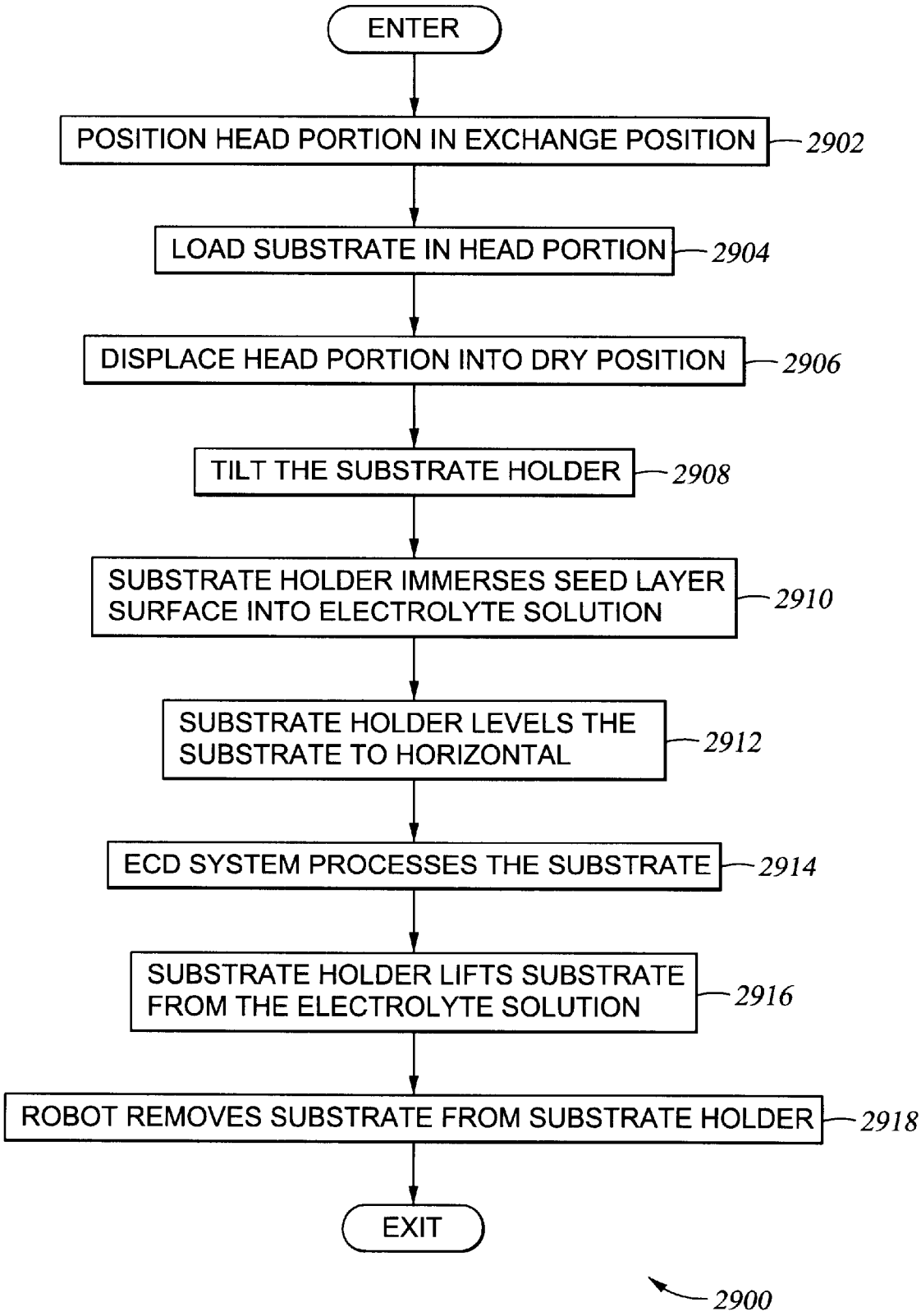
FIG. 7 shows a block diagram of an embodiment of the logic performed by a controller during operation of the head assembly through the progression shown in FIGS. 5A to 5H.

One embodiment of the progression of the substrate holder system 14 during the metal film deposition process is shown in FIGS. 5A to 5H. FIG. 7 shows one embodiment of method 2900 for performing the progression of the substrate holder system 14 shown in FIGS. 5A to 5H, as controlled by the controller 2002 The progression of the substrate holder system 14 shown in FIGS. 5A to 5H is to be read in conjunction with the method 2900 shown in FIG. 7. During the progression of FIGS. 5A to 5H, a substrate held in a substrate holder assembly is immersed into the electrolyte solution. The substrate is then processed within the electrolyte solution. Following processing, the substrate holder and the substrate are removed from the electrolyte solution, and the substrate is removed from the substrate holder assembly using a robot.

Figure 5B:
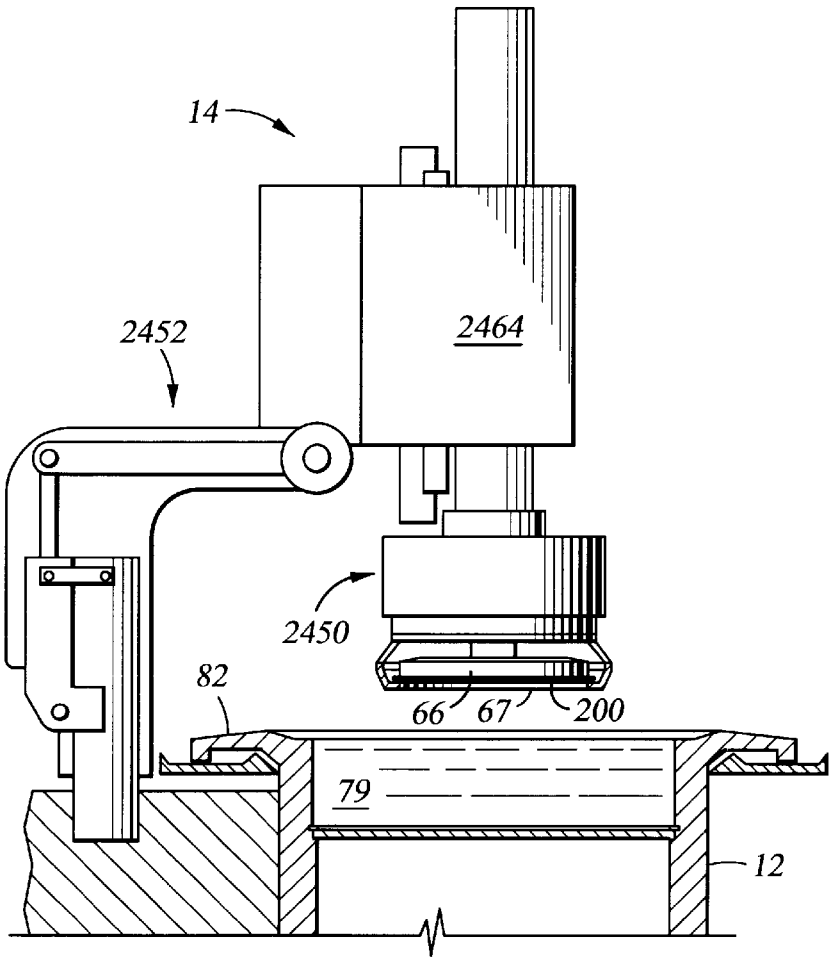
FIGS. 5A–5H show a partial cross sectional view of an exemplary progression of head assembly motions during a metal film deposition process.
Figure 5A:
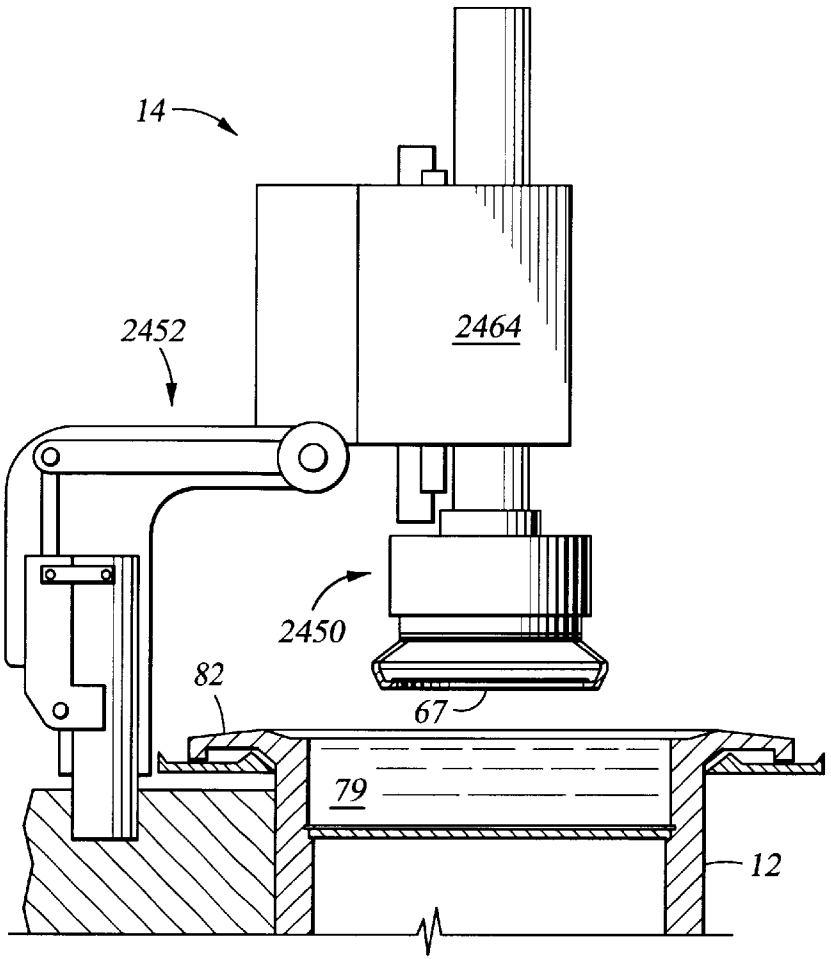

FIG. 5A, and block 2902 in FIG. 7, show the substrate holder system 14 being positioned in an exchange position in which the thrust plate 66 of the substrate holder assembly is retracted into a raised position by the creation of a vacuum in the pressure reservoir 2740. The substrate holder system 14 is positioned in its exchange position to allow a robot blade (not shown) to insert a substrate 200 between the electric contact element 67 and the thrust plate 66.

Figure 5D:
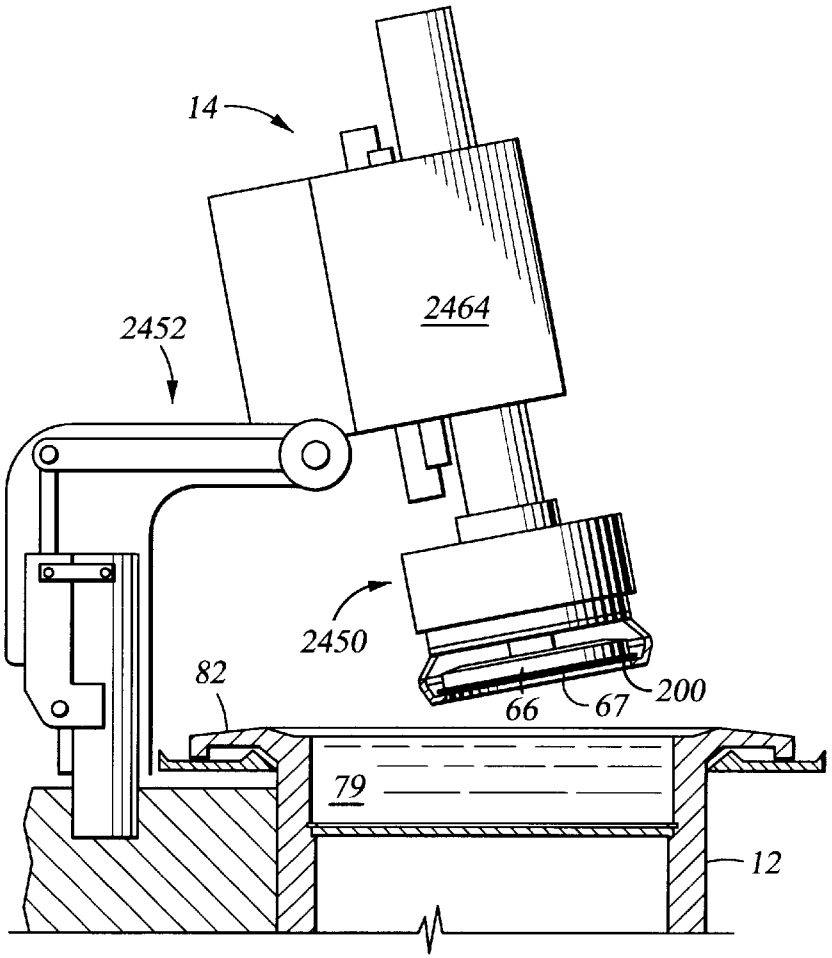

As shown in FIG. 5B, and block 2904 in FIG. 7, the substrate 200 is positioned between the thrust plate 66 and the electric contact element 67. The thrust plate 66 is then lowered to exert a bias against the backside of substrate 200 to secure and provide a sufficient electric contact between the plating surface and the contact element. The thrust plate is lowered with such force to secure, but not damage by excessive , the substrate 200. The lowering of the thrust plate is accomplished by decreasing the vacuum applied within the pressure reservoir 2740 shown in FIG. 3B to allow the spring bellow connector 2729 to return downwardly to its pre-set position. During the remaining substrate 200 processing, the thrust plate remains in the lowered biased position until the thrust plate in the substrate holder assembly is raised to the exchange position as indicated by FIG. 5H. In those embodiments of substrate holder system 14 in which the substrate can be rotated, the substrate holder system starts angular rotation of the substrate in FIG. 5B about a vertical axis passing through the substrate, and continues through FIG. 5H. The velocity of angular rotation may vary through the progression depending upon whether the substrate is being immersed in the electrolyte solution, the substrate is being processed, or the substrate is being removed from the electrolyte solution, or the substrate is being rotated for drying of the substrate by centrifugal force.

Figure 5C:
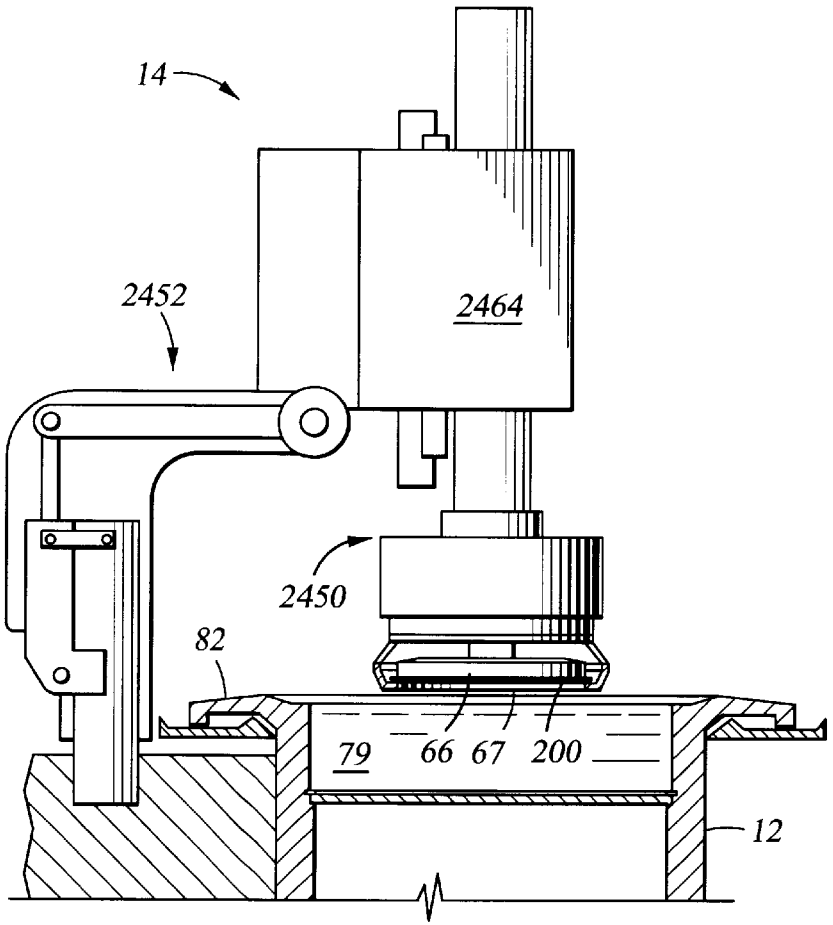
Figure 5F:
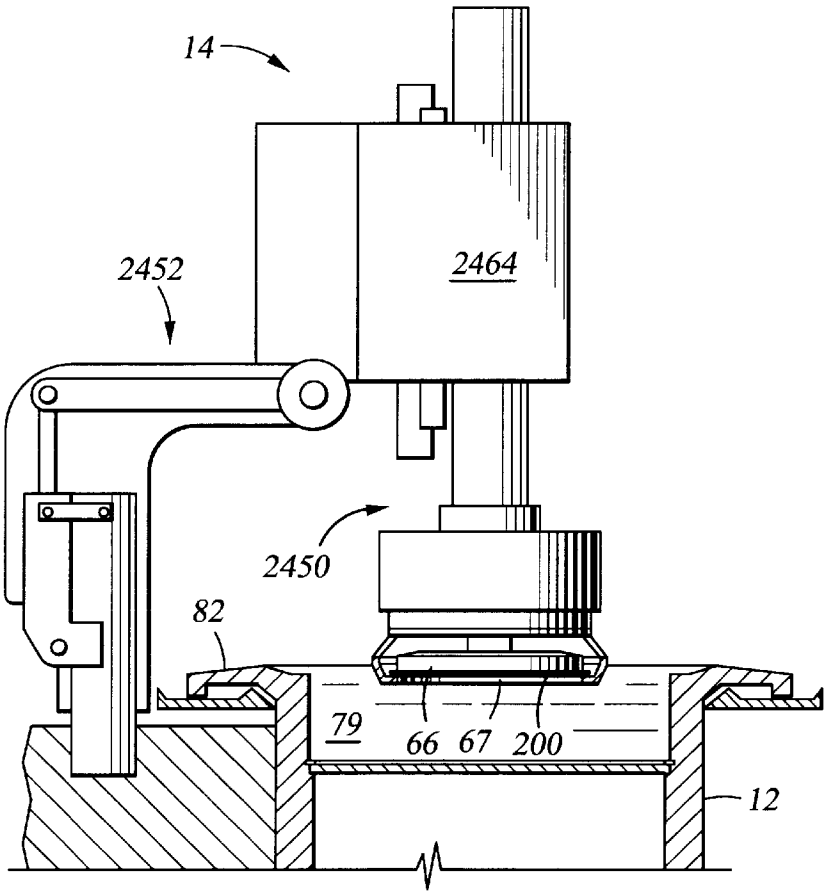

FIG. 5C, and block 2906 of FIG. 7, shows the substrate holder assembly 2450 being lowered to a position in which the lift guide 2466 being translated downward relative to the mounting slide 2460. In this position, the substrate holder assembly supports the substrate 200 above the electrolyte solution contained in the electrolyte solution cell 12. The substrate 200 is positioned in this position prior to its immersion into the electrolyte solution, and also after the substrate has been removed from the electrolyte solution. Positioning the substrate 200 in position is part of a routine such that the substrate 200 can be quickly immersed into the electrolyte solution.

FIG. 5D, and block 2908 in FIG. 7, shows the substrate holder assembly 2450, the rotating actuator 2464, and the head lift portion 2708 all being tilted as a unit by the head assembly frame 2452 about the pivot joint 2459. A cantilever arm actuator 2457 controllably actuates shaft 2453 and the connected cantilever arm 2456 to effect tilting of the rotatable head assembly 2410, that holds the substrate, about the pivot joint 2459. The tilting of the seed layer on the substrate is provided to enhance the immersion of the seed layer into the electrolyte solution, as shown in FIG. 5E.

Figure 5E:
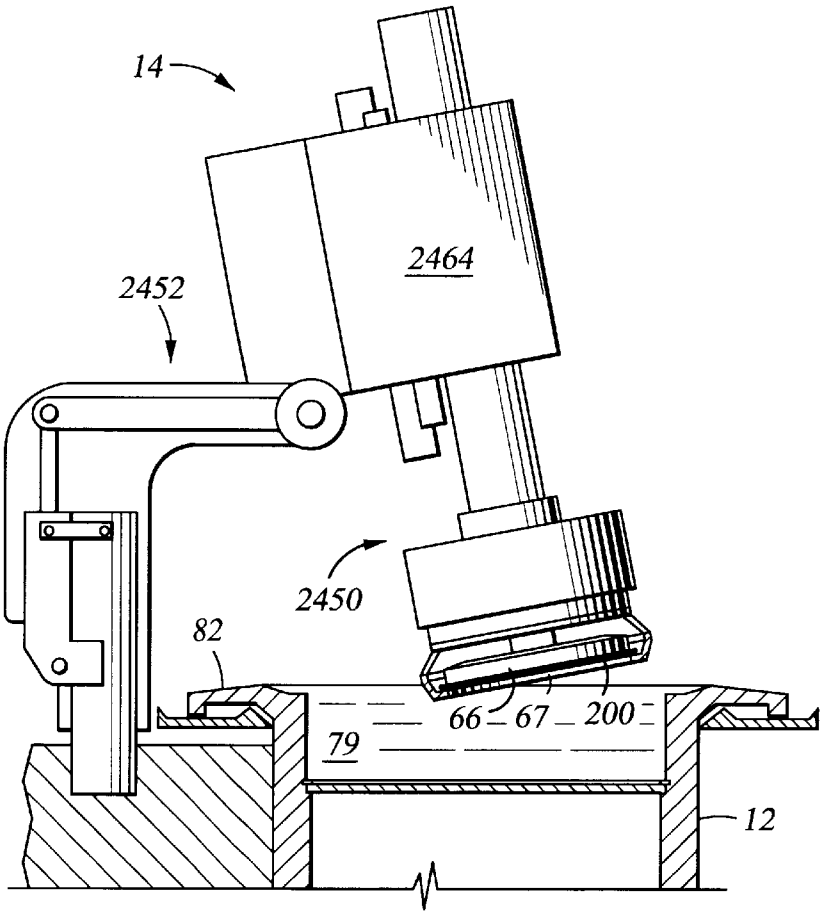
Figure 5H:
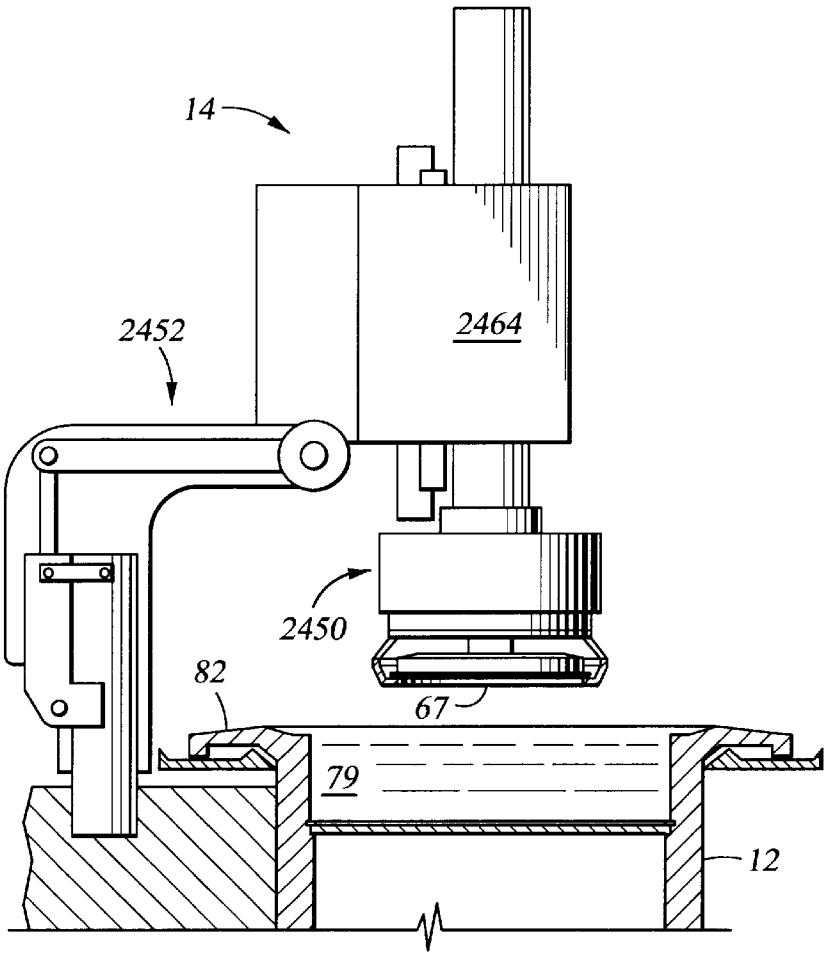

FIG. 5E, and block 2910 of FIG. 7, shows the immersion of the substrate 200 contained in the rotatable head assembly 2410, into the electrolyte solution from the dry position. The shaft 2468 is rotated during the immersion of the substrate. During this shaft rotation, the lift guide 2466 is translated downwardly along the mounting slide 2460 to cause downward motion of the head assembly 2410. Substrate 200 is tilted from horizontal when the substrate is immersed in the electrolyte solution to minimize the occurrences of air bubbles and air bridges trapped underneath the substrate/substrate holder assembly within the electrolyte solution. Tilting the substrate upon immersion acts to release some of the air bubbles trapped under the substrate as the substrate 200 is lowered into the electrolyte solution, and also lets the air bubbles escape more easily across the tilted substrate face. The tilted position at which the substrates are immersed in the electrolyte solution enhance the flow of a meniscus formed between the electrolyte solution and the substrate, across the surface of the seed layer on the substrate. In addition, spinning of the substrate during immersion minimizes the chance that an air bubble will become attached to any single location on the seed layer.

As shown in FIG. 5F and block 2912 of FIG. 7, the rotating actuator 2464, and the mounting slide 2460 are all moved as a unit by the head assembly frame about the pivot joint 2459 into the process position. When the head portion is in the process position, the substrate 200 is held in a substantially horizontal position within the electrolyte solution. In the process position shown in block 2914 of FIG. 7, the entire plating surface of the substrate 200 is immersed in the electrolyte solution.

During the electroplating process, portions of the head portion 2450 including the contact housing 2765, the thrust plate 66, the electric contact element 67 may be rotated between about 0 and about 200 RPM, preferably from about 20 to about 40 RPM. The rotation of the substrate 200 enhances uniform deposition of the metal ions across the plating surface. The metal ions produced by the reaction between the electrolyte solution and the anode 16 is deposited on the plating surface of the substrate 200 when the substrate holder system 14 is in the process position.

Figure 5G:
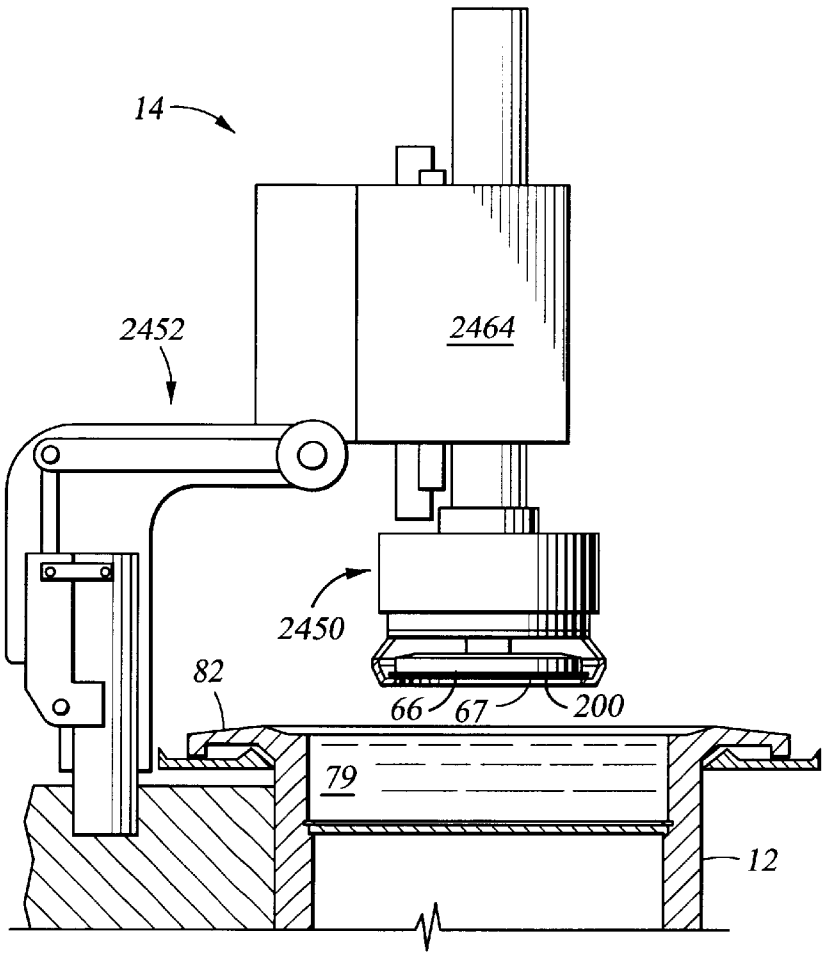

As shown in FIG. 5G and block 2916 of FIG. 7, the head portion 2450 is then displaced by the substrate holder system 14 into a drying position after the processing is performed on the substrate 200. To provide for the displacement between the process position shown in FIG. 5F and the dry position shown in FIG. 5G, lift guide 2466 is translationally displaced upwardly relative to the mounting slide 2460. Additionally, the head assembly 2410 can be tilted about the pivot joint 2459 (this tilting is not shown) to enhance the meniscus flow of the electrolyte solution across the seed layer as the substrate is removed from the electrolyte cell. When the head portion 2450 is in the dry position, the substrate may be rotated between about 600 and about 2500 RPM, preferably about 2000 RPM to dry the substrate 200 by centrifugal action. Alternatively, the substrate 200 can be transported to a separate spin-rinse-dry unit.

As shown in FIG. 5H and block 2918 of FIG. 7, the head portion 2450 is then raised into the exchange position by the lift guide 2466 being translationally displaced upwardly relative to the mounting slide 2460. When the head portion is in the exchange position, the thrust plate 66 is raised to facilitate removal of the substrate 200 from the substrate holder assembly. Following the raising of the thrust pad, a first robot blade, not shown, is typically inserted between the substrate 200 and the thrust plate to remove a first processed substrate. Another robot blade inserts a new substrate to be processed on to the electric contact element. The thrust pad is then lowered to secure the substrate in position within the substrate holder assembly. The metal deposition process depicted in FIGS. 5A to 5H is then performed on the next substrate.

There are multiple embodiments disclosed herein that result in a greater concentration of metal ions contained in the electrolyte inside the features of an object to be plated. The increased concentration of metal ions within the features facilitates bottom-up deposition, and/or improves metal film deposition uniformity.

3. Mechanical Vibratory System

In certain embodiments of the present invention, it is desired to vibrate the substrate, e.g. substantially vertically and/or horizontal, relative to the electrolyte solution. The vibration comprises repetition of a stroke of several microns (preferably the stroke is less than about 100$\mu$) to enhance the fluid flow of the electrolyte solution into the features contained on the plating surfaces. Though in certain embodiments, the vibration may occur at a rate as low as several cycles per second, other embodiments may provide the vibration in the kHz or mHz range. The selection of the particular embodiment depends on the characteristics of the electrolyte solution and metal ions, the dimensions of the features, and other such considerations. This increase in electrolyte solution fluid flow about the substrate enhances the concentration of metal ions contained within the electrolyte solution within the features because the flow positions electrolyte solution containing an enhanced number of metal ions (this electrolyte solution originated from a location remote from the depletion region) proximate the throat of the feature. The metal ions contained in the electrolyte solution can flow within the electrolyte solution to within the features by diffusion. This flow enhances the concentration of metal ions within the features to a concentration approaching, or equal to, the concentration of the metal ions in the electrolyte solution outside the features. The increase in the concentration of metal ions in the feature results in enhanced metal film deposition rate within the features.

There are multiple mechanical techniques by which the concentration of metal ions contained in the electrolyte solution contained within the features of the plating surface of a substrate can be increased by vibration. In one embodiment, the substrate 200 is displaced, typically vibrated, relative to the electrolyte solution. In another embodiment, the electrolyte solution is vibrated relative to the substrate 200. Both embodiments take the general form of establishing a vibration between the substrate 200 and the electrolyte solution.

Figure 2A:
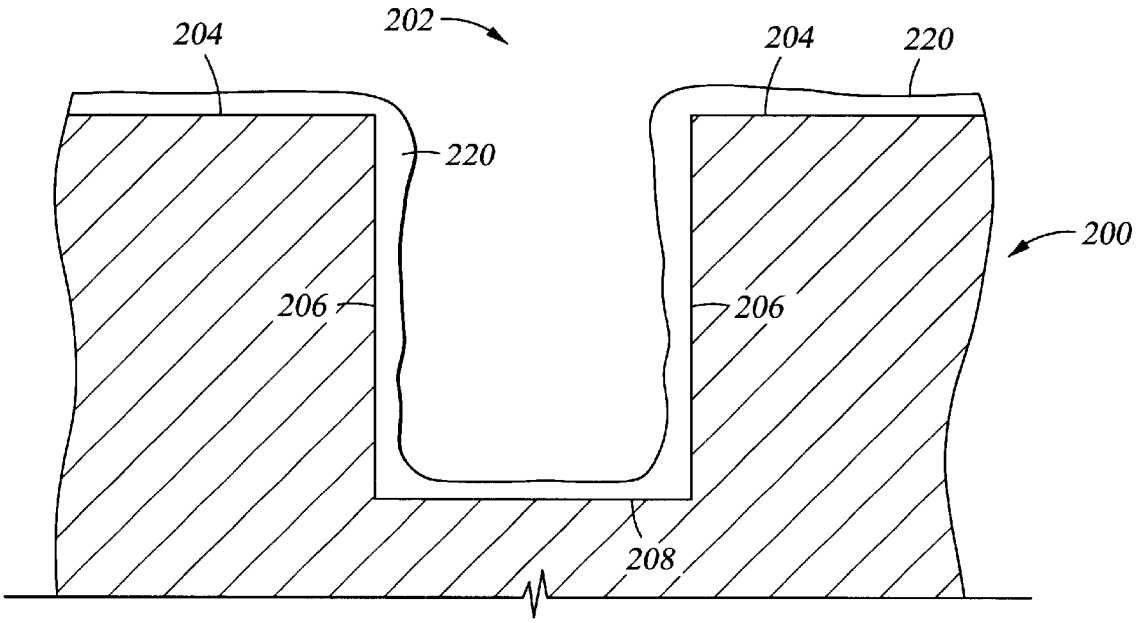
FIG. 2A shows a side cross sectional view of a substrate including a feature such as a via or trench.

The mechanical vibrations between the substrate 200 and the electrolyte solution may be produced by piezoelectric, ultrasonic, or magsonic sources and performed during the early stage of the ECP process, prior to the time when most of the metal ions are deposited on the horizontal field 204 as shown in FIG. 2A. As typical feature widths decrease and aspect ratios increase, it is more difficult for an electrolyte solution with sufficient ion concentration to flow into the feature in the initial few seconds of the metal film deposition process. The mechanical vibration applied from the substrate holder system 14 to the substrate 200 enhances electrolyte diffusion in the feature, and improves the early stage of plating in which the features are being filled by metal film. Such feature-filling deposition typically occurs within the first few seconds of metal film deposition.

Figure 4:
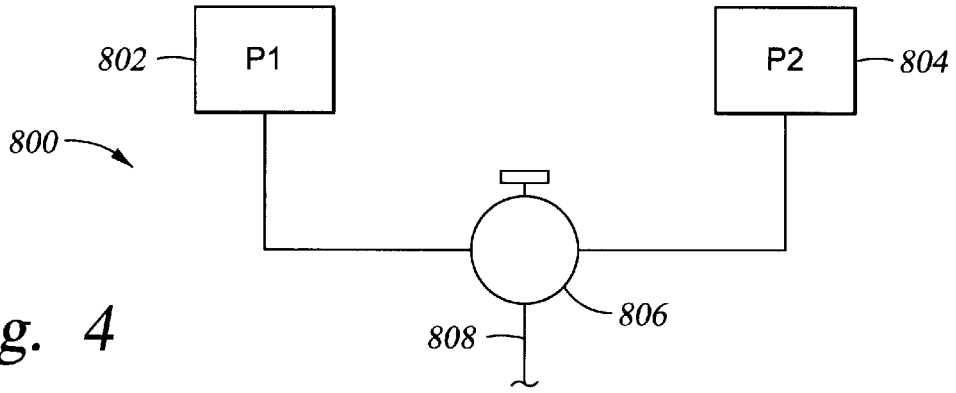
FIG. 4 shows an embodiment of a vibratory inducement device located within the head assembly of the substrate holder system shown in FIG. 3A.
Figure 8:
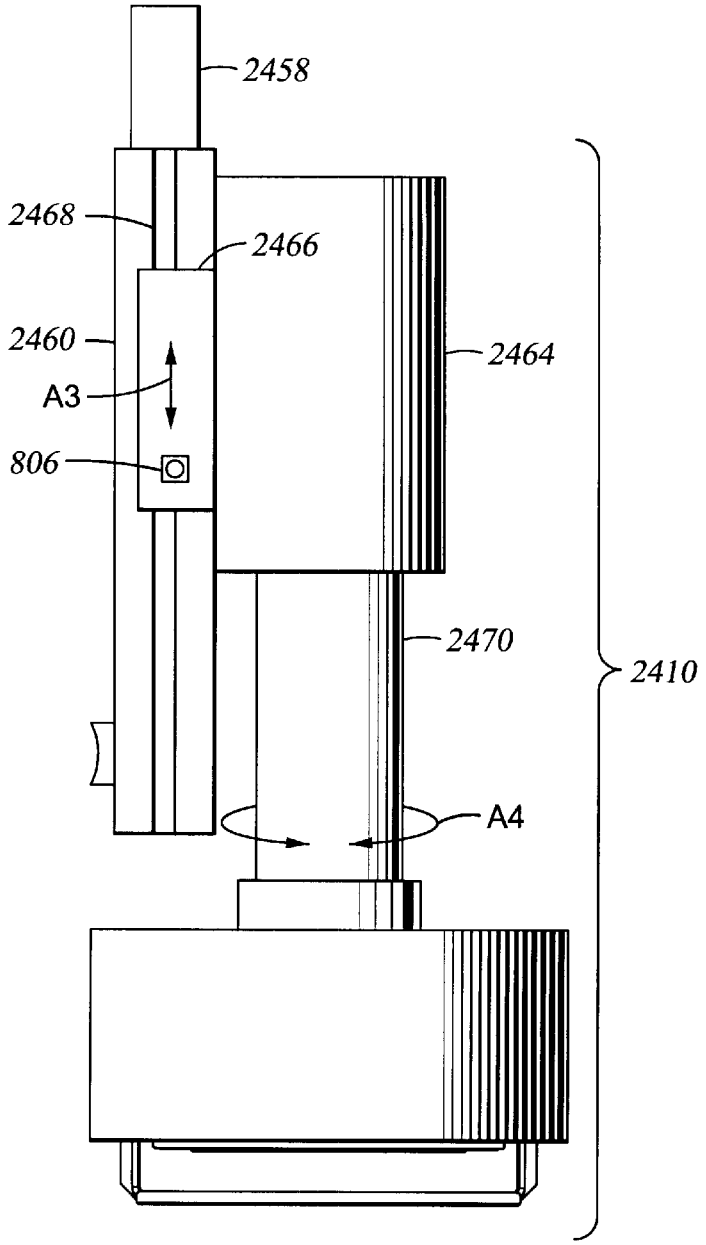
FIG. 8 shows an embodiment of a vibratory inducement device located within the head assembly.

Several embodiments of modifications to the substrate holder system are now described that can be used to vibrate the substrate 200. Vibrational amplitude of the substrate 200 in the range of tens of microns has a beneficial effect on the metal film deposition rate during plating operations. FIG. 8 shows one embodiment of substrate holder System that can vibrate the substrate 200 relative to the electrolyte solution. Another embodiment of system that may be used to impart vibration to a substrate is shown in FIG. 4.

Figure 2B:
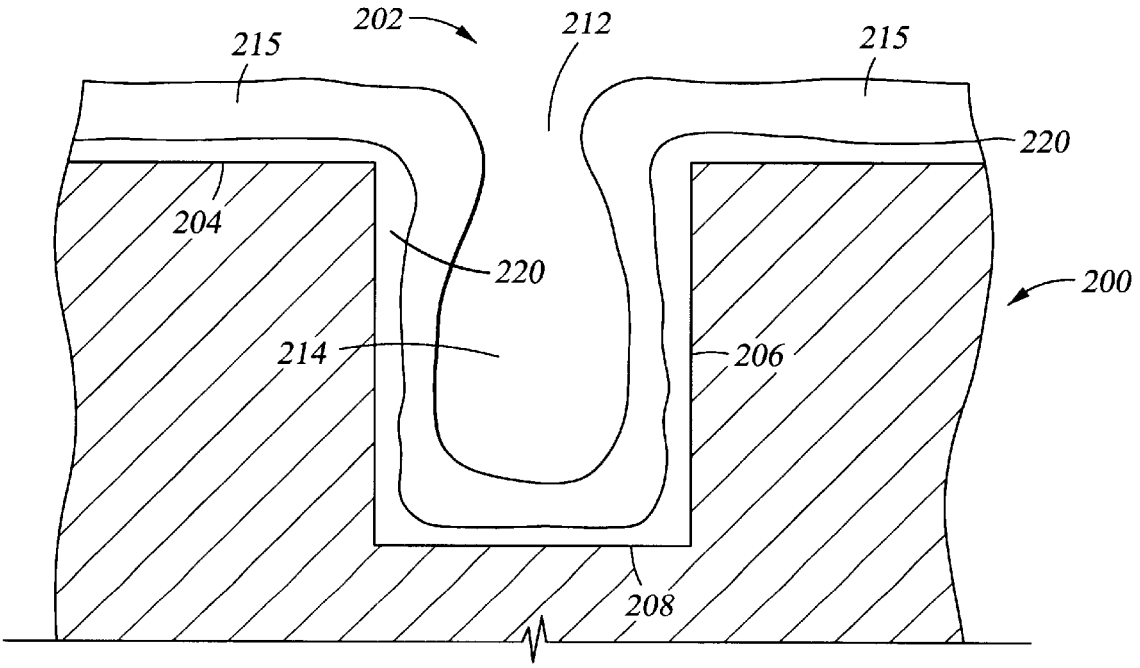
FIG. 2B shows the substrate of FIG. 2A with a deposited metal film.

The vibration of the substrate may be imparted during the metal film deposition and during the immersion process. During the immersion of the immersion of the substrate into the electrolyte solution, a small negative voltage between about 0.5 and about 1.5 volts, preferably about 0.8 volts, is applied to the cathodic seed layer on the substrate to effect negative biasing of the seed layer relative to the anode. During the negative biasing the substrate 200 is inserted into the electrolyte solution as shown and described above in reference to FIGS. 5D and 5F. This small bias is applied before the substrate 200 is fully electrically loaded to effect metal ion deposition on the horizontal field 204. This negative bias voltage is provided to permit bottom-up metal ion deposition in the features of the seed layer, but not enough to choke off these features. To accomplish bottom-up deposition during the initial negative biasing, the concentration of metal ions contained in the electrolyte solution is enhanced near the bottom of the feature to enhance the bottom-up deposition before the features are choked off. This increased metal ion concentration is accomplished by vibrating the substrate relative to the electrolyte solution to increase the number of metal ions that are contained within the features. Though the vibration is described relative to an approximately 0.8 volt bias, it is envisioned that the vibration concept applied herein may also be used in conjunction with other bias process conditions where it is desired to enhance the concentration of metal ions in the electrolyte solution contained within the features. After the features are filled, the metal ions are further deposited on the horizontal field by the "loading" or massive plating to form the metal film on the substrate seed layer. The loading is that portion of the biasing which the majority of thickness of the deposition layer is applied to the horizontal field 204 in FIG. 2.

The 0.8 bias voltage applied to the substrate 200 is also sufficient to compensate for any etching of the substrate seed layer by the 0.8 volt biasing is applied before the loading of the substrate 200 within the electrolyte solution compensates for the acidity of the electrolyte solution. The seed layer deposited on the substrate 200 will dissolve without this biasing voltage.

It is important to monitor the copper plating thickness while vibrating the substrate during the initial portions of the metal film deposition. If the Cu layer is too thin, the plated Cu layer as well as the original Cu seed layer will be etched away by the acidic electrolyte. If the Cu layer is too thick, it will restrict the throat of the feature 202 thus limiting further entrance of electrolyte solution and metal ions into the feature. Therefore it is important to apply a negative bias to the substrate 200 both before and during the mechanical vibration phase. The frequency and amplitude of mechanical vibration may need to be adjusted. Excessive vibration may cause delamination of the then plated Cu layer and/or the seed layer from the underlying Ta or TaN diffusion barrier layer. Insufficient vibration will not enhance the migration of Cu ions and other additives to the feature bottom. A proper vibration level will therefore reduce substrate 200 feature defects.

The application of mechanical vibration to the substrate 200 to accomplish this bottom-up deposition is now described with reference to FIGS. 3B and 8. The vibration of the substrate 200 may be accomplished as shown in FIG. 3B by a vibratory inducing device 702 being positioned at appropriate locations within the substrate support system such as on the thrust plate 66. In the embodiment shown in FIG. 8, the vibration inducing device 806 is mounted on the lift guide 2466. Any vibration inducing device that applies sufficient vibration to the substrate is within the scope of one embodiment of vibration inducing device. The desired vibrational amplitude to the substrate is preferably within the range of 0.2 microns ($\mu$) to 100$\mu$, and more particularly from 0.8$\mu$ to 8$\mu$. In another embodiment of vibration inducing device as shown in the embodiment of FIG. 1, a vibration is applied to a flow diffuser to cause a vibration of the electrolyte solution relative to the substrate. In the embodiment shown in FIG. 1, a flow diffuser 71 extends across the inner wall of the upper electrolyte cell 92. A piezoelectric driver 73 that is mounted to the wall of the electrolyte cell is also mounted to the diffuser 71. The piezoelectric driver can induce vibration of the electrolyte solution in the electrolyte cell 12. The vibration of the electrolyte solution is imparted to the substrate. Vibrating the electrolyte solution within the electrolyte cell that is applied to the substrate enhances the supply of metal ions to adjacent the seed layer. Enhancing the supply of metal ions to the seed layer (including the features formed in the seed layer) also enhances the metal film deposition on the seed layer including the seed layer within the features. The different embodiments of vibratory inducing devices 702 are applied to the rotatable head assembly 2410 and the mounting slide 2460, even though these embodiments are illustrative in nature and are not intended to be limiting in scope.

In an embodiment of vibratory inducing device shown in FIG. 8, a vertical vibration device 702 is connected directly to the lift guide 2466. The lift guide 2466 is displaced relative to the shaft or track 2468. The vertical vibration device 702 comprises a piezoelectric element having an associated transducer. The output from the transducer outputs its displacement readings to the controller 2002 that senses the produced vibration, and ensures that the vibration remains within the above desired vibratory ranges. One example of a piezoelectric element that can be used is commercially available from Piezoelectric Jena located in Jena, Germany as the series PA 150V stack type actuator. Such piezoelectric elements are capable of vibrations of about a 50 kHz frequency range with a stroke of about 8$\mu$m. The piezoelectric elements convert an applied electrical field into mechanical vibration. Other types of vibratory inducing devices that can produce such vertical vibratory motions include mechanical cam devices. The mounting slide 2460 and the rotatable head assembly 2410 may be viewed as a mass that will oscillate in a vertical direction under the vibrational influence of vibration device 702. The vibration amplitude and/or frequency of the vibration device 702 may be altered to provide the desired vibration amplitude and frequency to the substrate 200.

In another embodiment shown in FIG. 3B, the vibration device 702 such as a piezoelectric driver or mechanical oscillatory device may be positioned at the thrust plate 66. The thrust plate is considered a mass. The frequency, amplitude, and the power consumption calculation valves can be determined based upon known kinematic-based values. The frequency of the vibration device is configured to be in the range from a few kilohertz to about 300 kilohertz, but other vibratory ranges can be used and are within the scope of the present invention. While the above vibratory inducing devices have been shown connected to the head lift portion and the thrust plate, other embodiments can be configured by attaching a vibratory inducing device to other components, e.g. the substrate holder assembly 2450 such as between 2765 and 2470, attached to the mounting slide 2460, secured to the rotatable head assembly 2410, affixed to the head assembly frame 2452, or attached to any other location where the vibration may be transmitted from the vibration device to the substrate.

In another embodiment, the electrolyte solution is displaced in a reciprocating manner which displaces the electrolyte solution relative to the substrate 200. The vibratory inducing device 99 shown in the embodiment of FIG. 1 may operate either alone, or in combination with other vibratory inducing devices. The vibratory inducing device 99 includes the flow diffuser 71 and a vibration actuator 73. In one embodiment, the vibration actuator 73 may be mounted on the inner peripheral wall of the upper electrolyte cell 92 in a position that imparts vibrational impulses to the flow diffuser 71. The flow diffuser is sufficiently flexible to result in the production of a vibrational mode in response to the vibrations from the vibration actuator 73 having a vertical amplitude in the micron range, across the width of the electrolyte cell. The flow diffuser is configured to allow electrolyte solution to flow there through during normal plating operations (typically in a generally upward direction). However, the frequencies of the oscillations applied to the flow diffuser are sufficient to cause the flow diffuser to import the vibration to the electrolyte solution in the electrolyte cell. The vibrational impulses within the electrolyte solution 79 are caused by the vibrational action of the flow diffuser 71. The vibrational impulses may also be caused in an alternate embodiment by the direct vibrational action of the vibrational actuator 73. The vibrating flow diffuser and/or the vibrating vibrational actuator produce standing waves in the incompressible electrolyte solution contained within the electrolytic cell. The standing waves produced by the vibration of the flow diffuser to the electrolyte solution contained within the electrolyte cell above the flow diffuser "spread out" throughout the electrolytic cell and their energies tend to cancel each other out. In this embodiment, the frequency and amplitude of the vibration actuator 73 and the flow diffuser 71 shown in FIG. 1 have to be adjusted to ensure a desired vibrational amplitude of the electrolyte solution.

Another embodiment to provide a vibration of the electrolyte solution relative to the thrust plate 66 occurs by alternating the level of pressure contained within the pressure reservoir 2740. When the pressure in the reservoir changes, the thrust plate 66 moves to equalize the counteracting biasing forces supplied by fluid vacuum in the pressure reservoir 2740 against the spring assembly 2732.

Changing the pressures within the pressure reservoir has the effect of displacing the thrust plate 66 several microns in the vertical direction. One embodiment of pressure alternating device 800 that can alter the pressure applied to the pressure reservoir 2740 is shown in FIG. 4. The pressure alternating device 800 comprises a first pressure vessel 802, a second pressure vessel 804, a controllable valve 806, and a valve outlet 808. The first pressure vessel 802, and the second pressure vessel 804 are maintained at unequal pressures of P1 and P2, respectively, and are in fluid communication with respective inlet ports of controllable valve 806. The sources of the pressure P1 and P2 may be pressurized fluid, compressors, or any device that applies compressed fluid. The controllable valve 806 applies the fluid pressure from either the first pressure vessel 802, the second pressure vessel 804, or neither the first nor the second pressure vessel to an output port 808. The output port 808 is in fluid communication with the pressure reservoir 2740. The application of pressure PI to pressure reservoir 2740 results in the thrust plate 66 being moved to a different vertical level than when pressure P2 is applied as shown in FIG. 3. The controllable valve 806, which is preferably an electrically operated quick-acting valve, such as a solenoid valve, that cycles between applying pressures P1 and P2 to the pressure reservoir.

Such cycling of pressures results in a vibration being applied to the substrate 200. The frequency of the oscillations is limited by the operation of the controllable valve 806. It is envisioned that this embodiment will be capable of operating at lower frequencies than the other embodiments that include, e.g., a piezoelectric or electromechanical driver. The pressure difference between P1 and P2 is sufficient to produce a vibration to the substrate of between about 0.2 microns ($\mu$) and about 100$\mu$, and more particularly from about 0.8$\mu$ to 1.5$\mu$, but does not produce an excessive vibration of the substrate. The operation of the controllable valve 806 is controlled by controller 2002, shown in FIG. 1, as described below. There are other embodiments that provide for vibration of the thrust plate 66, as described below.

4. Pressure Application Embodiment

Another embodiment by which the metal ion concentration in the electrolyte solution can be enhanced within the feature relative to outside the feature, during the early stages of metal film deposition, involves the application of pressure to the electrolyte solution. The enhanced metal ion concentration within the features enhances the metal film deposition on the seed layer within the features.

In one embodiment, pressure is created within the electrolyte solution by temporarily closing all the inlet and outlet valves to the electrolyte cell, and the substitute holder system 14 and the substrate forming a sealed surface that is biased against the electrolyte solution. The pressure established within the electrolyte solution forces the electrolyte solution containing metal ions into the features in the substrate under the force caused by the fluid pressure, thereby enhancing the concentration of metal ions in the features, compared to where no pressure is applied to the electrolyte solution. Forcing the metal ions in the electrolyte solution into the features enhances the injection of metal ions into the features when the features are in the sub-micron range. The pressure applied to the electrolyte solution, that is typically less than about 10 atmosphere and preferably under about 2 atmosphere, can be utilized to bias the metal ions into the features formed in the substrate. For example, if the substrate is displaced against the electrolyte solution to build-up pressure in the electrolyte solution in the electrolyte cell, then the electrolyte solution being forced into the features in reaction to the downward motion of the substrate (caused by the downward motion of the substrate holder assembly) has a greater tendency to bias the metal ions within the electrolyte solution into the features.

One embodiment of ECP system 10 comprising the progression involved in deposition shown in FIG. 6A through FIG. 6D. The ECP system 10 includes the electrolyte cell 12 and a sealable head assembly 620. The electrolyte cell 12 of FIG. 1 is modified to permit the application of a pressure to the electrolyte solution 79 contained in the electrolyte cell 12 by controlling the positions and operations of an outlet port 610, a bleeding valve 612, and the sealable head assembly 620. The outlet port 610 is an optional alternative to the annular weir 83 shown in the embodiment of FIG. 1 that permits the escape of electrolyte solution from the electrolyte cell 12 to create circulation of the electrolyte solution through the electrolyte cell. Since the duration of the application of the pressure to the electrolyte solution is relatively brief to enhance the metal film deposition in the features the pressure can be applied to the electrolyte solution for a brief period without any outlet port 610 or bleeding valve 612. An inlet valve 616 is connected to the input port 80, and the inlet valve 616 can be closed to limit backflow through the input port when pressure is applied to the electrolyte solution contained in the electrolyte cell 12.

Figure 6B:
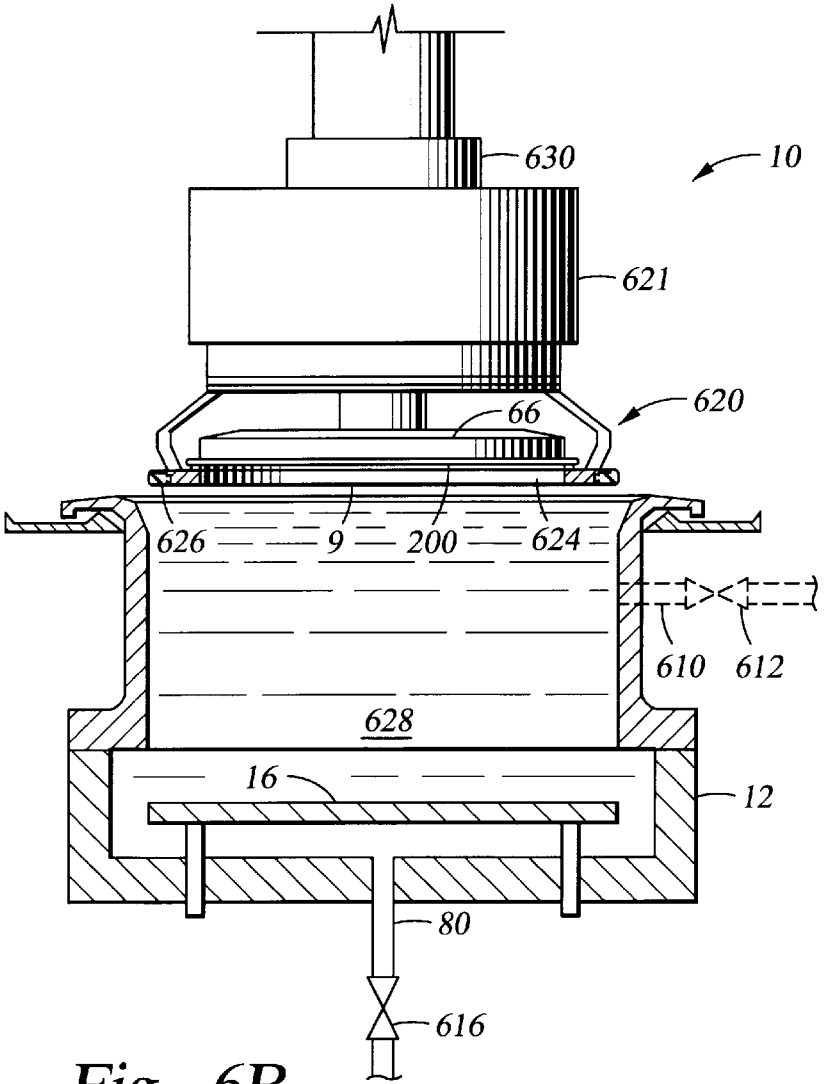
FIGS. 6A–6D show a cross sectional view of an exemplary progression of an electroplating chamber having one embodiment capable of applying pressure to the chamber.
Figure 6A:
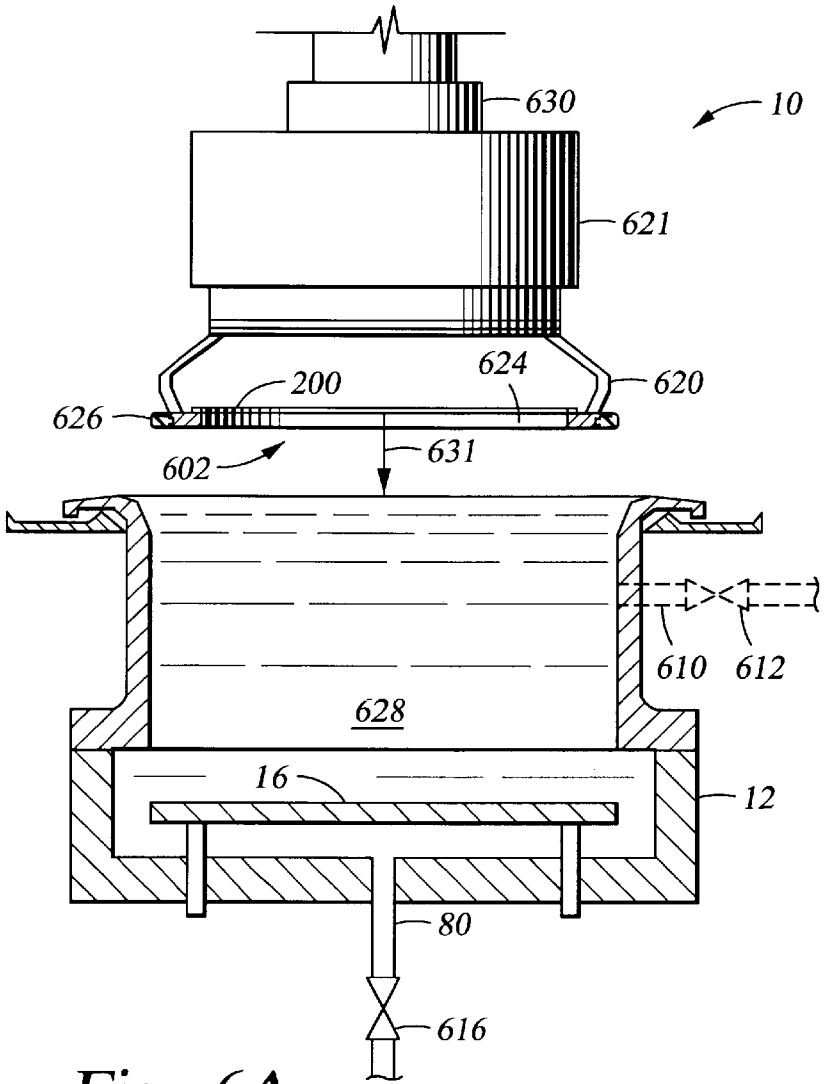
Figure 6D:
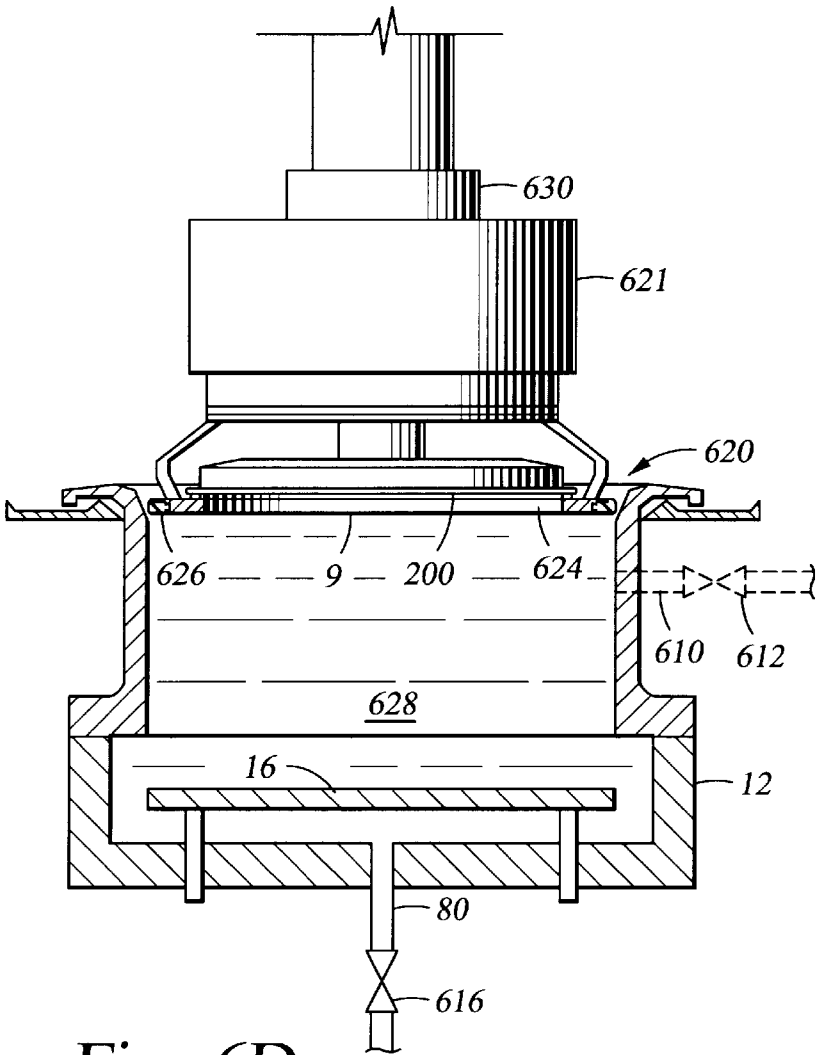
Figure 6C:
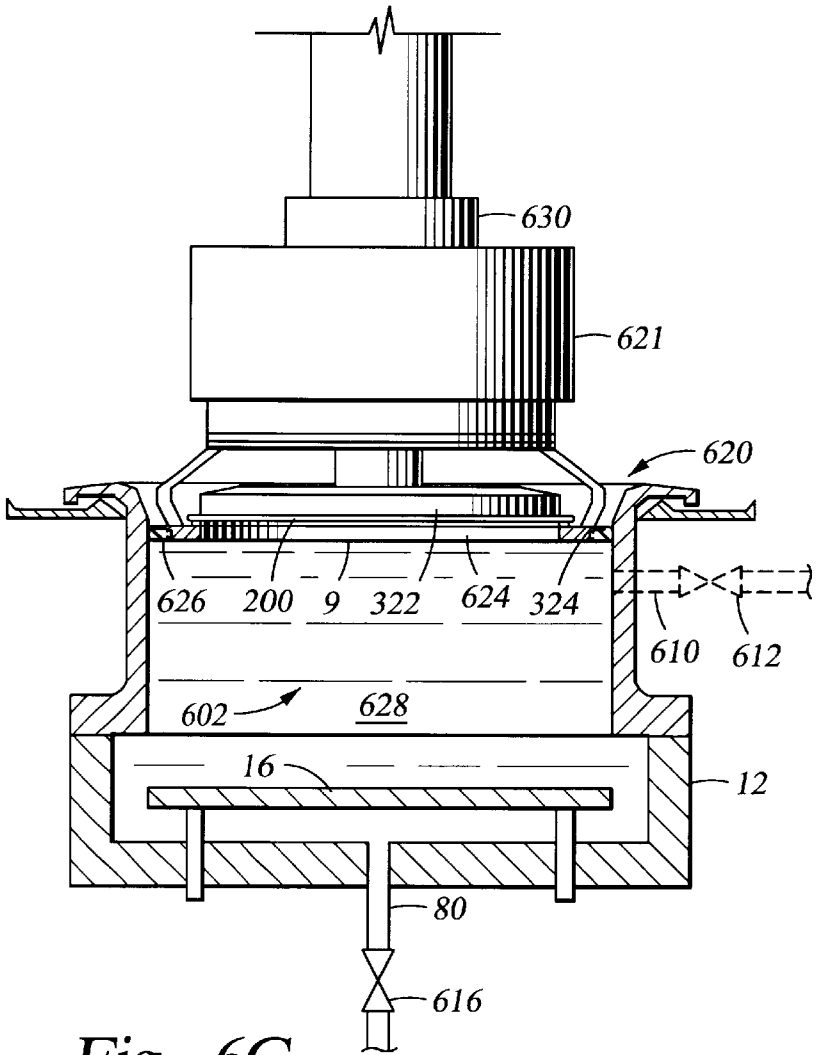

To provide for pressurizing the electrolyte solution, the sealable head assembly 620 forms a sealing arrangement with the electrolyte cell 12 when lowered to the position shown in FIG. 6C. The sealing head assembly comprises an annular seal 626 formed from a sealing, e.g. elastomeric material, that extends about the electric contact element of the substrate holder assembly 64. The diameter of the generally circular electric contact element is configured to support the periphery of the downward-facing front side of the substrate. Therefore, those seed layer locations on the substrate that are within the peripheral locations will be in physical contact with the electrolyte solution when the substrate/substrate holder assembly is lowered to be immersed in the electrolyte solution. The external peripheral surface of the annular seal has a circular dimension similar to that of the inner surface of the electrolyte cell to be able to create a seal with the electrolyte cell to be able to pressurize the electrolyte solution in the electrolyte cell when the substrate/substrate holder assembly is in the position shown in FIG. 6C.

A seal is also provided between the electric contact element and the substrate to seal against fluid escaping between these two elements. The seal between the electric contact element and the substrate may be, e.g., an elastomeric, plastic, or similar seal and may be a unitary circular seal or a multi-element seal. The sealing action of this seal is enhanced by downward force applied by the thrust plate. A piston rod 630 is shown connected to upper cylindrical plate 621 in a manner such that rotational motion provided by an embodiment of substrate holder system 14 similar to the embodiment shown in FIG. 1 may be controllably imparted to the sealing head cylinder 620. No rotation exists between the substrate holder assembly (including the substrate) and the electrolyte cell during pressurization of the electrolyte solution, but some rotation may be imparted during the metal film deposition that occurs as the substrate holder assembly is displaced to its process position, following the feature filling. The contact ring 9 and the thrust plate 66 are provided in the embodiment of the sealable head assembly 620 shown in FIG. 6. The contact ring and the thrust plate act to retain a substrate 200 in position to provide electricity to the plating surface of the substrate, and allow rotation to the substrate 200 in a similar manner as described relative to the embodiment shown in FIG. 1.

FIGS. 6A to 6D show one embodiment of the methodology in which fluid pressure may be applied to a plating surface of a substrate 200 to enhance the concentration of metal ions contained in the electrolyte solution within the features of substrate during the early stages of metal film deposition.

In FIG. 6A, a substrate 200 is loaded from a robot blade (not shown) into the sealable head assembly 620 as described above relative to the embodiments shown in FIGS. 3A and 3B. The sealable head assembly 620 is positioned above the electrolyte solution 78 during the insertion of the substrate 200 into the head assembly. The sealable head assembly 620 is then lowered in the direction indicated by arrow 631.

In FIG. 6B, a controlled negative bias is applied to the substrate 200 to limit excessive plating while the head holding the substrate is moved to the process position. The substrate 200 may be rotated during the initial loading by actuation of the head rotation portion 2706 shown in FIG. 3B, and the head submerges the substrate 200 into the electrolyte solution 78 by actuation of the mounting slide 2460 shown in FIG. 3A. This rotation is to cease prior to a seal being formed between the substrate holder assembly and the electrolyte cell. This seal effects pressurization of the electrolyte solution and can be formed when the substrate holder assembly is stationary relative to the electrolyte cell. During the substrate immersion phase, the substrate seed layer can be charged with a small negative or positive voltage relative to the anode to repel the positively charged metal, e.g. copper ions, relative to the seed layer and thereby limit the amount of metal film deposition during the immersion of the seed layer on the substrate into the electrolyte solution since uniform metal film deposition on the seed layer is difficult to achieve during the substrate immersion process. The level of the voltage applied to the seed layer on the substrate is insufficient to provide de-plating of the seed layer.

In FIG. 6C, the electrolyte solution in the electrolyte cell 15 is pressurized to enhance the metal film deposition. The pressurization requires all the inlets and the outlet ports to the electrolyte cell (excluding the overflow of the electrolyte cell) to be closed to allow for the pressurization within the cell. The pressurization process starts with the shut-off valve 616 being initially closed and the bleeding valve 612 being initially opened. The combined substrate holder assembly/substrate is downwardly displaced into a sealed position against the electrolyte solution stored in the electrolyte cell 12. The bleeding valve 612 is closed before the substrate holder assembly reaches the sealed position in which the annular seal 626 forms a sealing contact with the electrolyte cell 12. During the initial stages of metal film deposition that occur when the substrate holder assembly is in its sealed position, electrolyte solution is limited from passing between the substrate holder assembly and the inner side of the electrolyte cell by the sealing action of the annular seal 626 against the inner surface of the electrolyte cell. By moving the sealable head assembly 620 downward, a sufficient and controllable amount of pressure is established within the electrolyte solution contained within the electrolyte cell. The pressure established in the electrolyte solution when the substrate holder assembly is in its sealed position is sufficient to bias the metal ions contained in the electrolyte solution into the sub-micron features on the substrate as the electrolyte solution is biased into the features. This pressurization of the electrolyte solution can occur in combination with, or separately from, the vibration of the electrolyte solution relative to the feature on the substrate, or the vibration of the substrate relative to the electrolyte solution, as described in the embodiments shown in, e.g., FIGS. 1, 3A, and 3B to enhance the metal film deposition. The thrust plate 66 is configured to support the backside of the substrate against the pressure applied to the front (plating) side of the substrate. As such, the cross-sectional diameter of the thrust plate preferably should equal, or be only slightly less than, the diameter of the substrate. The positive pressure (when the substrate/substrate holder is in the position shown in FIG. 6C) is applied to the substrate 200 for a period of less than five seconds in most embodiments, to ensure metal ions contained in the electrolyte solution is displaced through the electrolyte solution sufficiently to facilitate metal ions flow into the features more effectively to deposit as metal film within the features. Since the metal film deposition rate may vary as a function of the selected metal ions and recipes used, the five second limit is considered as exemplary. The pressure may be applied from half a second to ten seconds or longer depending upon the chemicals included in the electrolyte solution and the configuration of the features of the plating surface.

The amount of pressure selected to be applied within the embodiment of the electrolyte cell 12, page 28 shown in FIG. 6C depends upon the chemical composition and properties of the electrolyte solution, the anode, and the seed layer. In certain ECP systems, a pressure of a 1.1 atmospheres or greater may be applied to the electrolyte solution within the electrolyte cell to enhance the metal film deposition. The pressure applied to the electrolyte solution is envisioned to be raised to such levels as ten or more atmospheres may be built up within the electrolyte solution. The 10 atmosphere level is provided because it is envisioned that above this pressure level it may be difficult to limit the bending of the substrate, maintain the structure integrity of the fragile substrate, and limit the sealing action against the electrolyte solution. It is envisioned hat pressures much higher than this could be used to enhance the metal film deposition ate. However, the application of any pressure (of above about 1.1 atmospheres) to the electrolyte solution that is provided to enhance the metal ion concentration within the features is within the intended scope of this embodiment of ECP system. The higher the pressures applied to the electrolyte solution within the seed layer, the more it becomes important to ensure the electrolyte cell is structured so it can withstand the applied pressures of the electrolyte solution.

The position of the ECP system shown in FIG. 6C is used to increase the pressure in the electrolyte solution to an above-atmospheric level during the early stage of the process, but prior to the massive Cu plating of the horizontal field when the features are filled. As size of the substrate features, e.g. vias or trenches, decrease and aspect ratios increase in the substrates, it becomes more important to apply pressure to the electrolyte solution to cause the electrolyte solution to flow into the feature within a several second time frame.

In the above embodiment, the pressure is described as being established by the substrate holder assembly/substrate being displaced toward the electrolyte solution to compress the electrolyte solution. Any known technique that creates a pressure in the electrolyte solution may be used. For example, electrolyte solution may be pumped into the electrolyte cell through the inlet port 80 shown in FIG. 6A. Other suitable pressure-creating device may be used to displace the metal ions in the electrolyte solution to within the features.

A pressure applied to the electrolyte solution ensures an electrolyte solution flow into the features that carries sufficient metal ions into the features that improve the seed layer patching and copper nuclation at the early stage of the Cu plating. The application of pressure may also enhance the bottom-up metal film deposition in the features as described, thereby minimizing the voids that might otherwise occur in the plated feature.

In this embodiment, the copper plating process is controlled during the initial phase that when pressure is applied to the electrolyte. As described above, the initial copper seed layer can be removed by the copper etching process by, e.g., a negative bias voltage being applied between the anode and the seed layer. If the initial copper seed layer is initially too quickly and too thick, electrolyte solution will be restricted from entering the feature. Therefore, there is a need to apply a controlled negative potential/current to the substrate 200 while applying a pressure.

In FIG. 6D, the inlet valve 616 is opened to release the pressure of the electrolyte solution within the electrolyte cell. Additionally, the head is returned to the process position and the substrate holder system 14 may rotate the substrate (in those embodiments that the substrate is rotated). In those embodiments that the substrate/substrate holder is rotated, the electrolyte cell and the annular seal 626 are positioned and configured such that when the substrate holder is in the process position shown in FIG. 6D, the annular seal 626 does not contact any portion of the electrolyte cell. This avoidance of contact between the annular seal and the electrolyte cell limits friction and abrasion that may otherwise occur there between. It is also envisioned that some form of rotary labyrinth seal may be provided between the electrolyte cell and the electric contact element to provide this sealing. After the head reaches the process RPM, suitable electric biasing to apply the massive ECP process is commenced. The pressure is not necessary in the FIG. 6D portion to force the metal ions into the features since the features have already been progressively filled with the deposited metal ions in the FIG. 6D portion.

The above embodiments shown in FIGS. 1, 3A, 3B, 4, 5A to 5H, 6A to 6D, 7, and 8 have described enhancing the metal film deposition early in the ECP, i.e. before the massive metal film deposition that applies a large amount of metal film to the horizontal surfaces 204 shown in FIG. 2A. It is envisioned that the embodiments described herein may be applied to any point in the metal film deposition process that it is desired to enhance metal film deposition in features.

Although various embodiments that incorporate the teachings of the present invention have been shown and described in detail herein, those skilled in the art can readily devise many other varied components that still incorporate these teachings.

What is claimed is:

1. A method of electroplating a plating surface of an object, the plating surface having features, the method comprising:

immersing the plating surface into an electrolyte solution; and mechanically enhancing the concentration of metal ions in the electrolyte solution contained in the features, wherein the mechanical enhancement comprises applying pressure to the electrolyte solution, wherein the electrolyte solution is in contact with the plating surface.

2. A computer readable medium that stores software containing a program which when executed by one or more processors, performs a method comprising:

immersing a plating surface having features formed therein into an electrolyte solution; and mechanically enhancing the concentration of metal ions in the electrolyte solution contained in the features.

3. The computer readable medium of claim 2, wherein the electrolyte solution is contained in an electrolyte cell.

4. The computer readable medium of claim 2, wherein the mechanical enhancement comprises mechanically vibrating the plating surface relative to the electrolyte solution.

5. The computer readable medium of claim 2, wherein the mechanical enhancement comprises mechanically displacing the electrolyte solution relative to the plating surface.

6. The computer readable medium of claim 5, wherein the electrolyte solution is mechanically displaced in a direction substantially perpendicular to the plating surface.

7. The computer readable medium of claim 2, wherein the mechanical enhancement comprises applying pressure to the electrolyte solution, wherein the electrolyte solution is in contact with the plating surface.

8. An apparatus that electroplates a metal film on a seed layer of a substrate, the plating surface having features, the apparatus comprising:

a substrate holder configured to hold a substrate having features, and a seed layer formed within the features, wherein the substrate holder immerses the seed layer in an electrolyte solution; and a piezoelectric driver configured to mechanically vibrate the substrate relative to the electrolyte solution to enhance the concentration of metal ions in the electrolyte solution contained in the features.

9. An apparatus that electroplates a metal film on a seed layer of a substrate, the plating surface having features, the apparatus comprising:

a substrate holder configured to hold a substrate having features, and a seed layer formed within the feature , wherein the substrate holder immerses the seed layer in an electrolyte solution; and a vibration system configured to mechanically vibrate the substrate relative to the electrolyte solution for a duration of less than about 10 seconds to enhance the concentration of metal ions in the electrolyte solution contained in the features.

10. An apparatus that electroplates a metal film on a seed layer of a substrate, the plating surface having features, the apparatus comprising:

a substrate holder configured to hold a substrate having features, and a seed layer formed within the features, wherein the substrate holder immerses the seed layer in an electrolyte solution; and a vibration system configured to mechanically vibrate the substrate relative to the electrolyte solution in the kHz or mHz range to enhance the concentration of metal ions in the electrolyte solution contained in the features.

11. The apparatus of claim 10, wherein the vibration system has an amplitude of less than or equal to about 10 $\mu$ (microns).

12. An apparatus that electroplates a metal film on a seed layer a substrate, the plating surface having features, the apparatus comprising:

a substrate holder configured to hold a substrate having features, and a seed layer formed within the features, wherein the substrate holder immerses the seed layer in an electrolyte solution; and a piezoeiectric driver configured to mechanically vibrate the electrolyte solution relative to the substrate to enhance the concentration of metal ions in the electrolyte solution contained in the features.

13. An apparatus that electroplates a metal film on a seed layer of a substrate, the plating surface having features, the apparatus comprising:

a substrate holder configured to hold a substrate having features, and a seed layer formed within the feature , wherein the substrate holder immerses the seed layer in an electrolyte solution; and a vibration system configured to mechanically vibrate the electrolyte solution relative to the substrate for a duration of less than about 10 seconds to enhance the concentration of metal ions in the electrolyte solution contained in the features.

14. An apparatus that electroplates a metal film on a seed layer of a substrate, the plating surface having features, the apparatus comprising:

a substrate holder configured to hold a substrate having features, and a seed layer formed within the features, wherein the substrate holder immerses the seed layer in an electrolyte solution; and a vibration system co figured to mechanically vibrate the electrolyte solution relative to the substrate in the kHz or mHz range to enhance the concentration of metal ions in the electrolyte solution contained in the features.

15. The apparatus of claim 14, wherein the vibration system has an amplitude of less than or equal to about 10 $\mu$ (microns).

16. A method for electroplating a metal film on a seed layer of a substrate, the plating surface having features, the method comprising:

immersing a substrate having features in an electrolyte solution, wherein a seed layer is formed within the features; and applying pressure to the electrolyte solution in which the substrate is immersed to enhance the concentration of metal ions in the electrolyte solution contained in the features.

17. The method of claim 16, wherein the pressure applied to the electrolyte solution is above about 1.1 atmospheres.

18. The method of claim 17, wherein the pressure applied to the electrolyte solution is about 2 atmospheres.

19. An apparatus that electroplates a metal film on a seed layer of a substrate, the plating surface having features, the apparatus comprising:

a substrate holder configured to hold a substrate having features, and a seed layer farmed within the features, wherein the substrate holder immerses the seed layer in an electrolyte solution; and a pressure inducing device configured to apply pressure to the electrolyte solution in which the substrate is immersed to enhance the concentration of metal ions in the electrolyte solution contained in the features.

20. The apparatus of claim 19, wherein the pressure inducing device applies a pressure of above and about 1.1 atmospheres to the electrolyte solution.

21. The apparatus of claim 20, wherein the pressure inducing device applies a pressure of about 2 atmospheres to the electrolyte solution.

22. The apparatus of claim 20, wherein the pressure inducing device applies a pressure of below about 10 atmospheres to the electrolyte solution.

* * * * *

UNITED STATES PATENT AND TRADEMARK OFFICE

CERTIFICATE OF CORRECTION

PATENT NO. : 6,610,189 B2
DATED : August 26, 2003
INVENTOR(S) : Wang et al.

It is certified that error appears in the above-identified patent and that said Letters Patent is hereby corrected as shown below:

Column 4,
Line 27, please change “as 10 in” to -- as in --
Line 30, please change “older” to -- holder --.

Column 5,
Line 3, please change “deposite” to -- deposit --.

Column 6,
Line 13, please change “$2H_2O \rightarrow O_2+4H^{30}+4e^-$” to -- $2H_2O \rightarrow O_2+4H^+ +4e^-$ --.

Column 17,
Line 47, please change “Pl” to -- P1 --.

Column 20,
Line 66, please change “hat” to -- that --.

Column 21,
Line 1, please change “ate” to -- rate --.

Column 24,
Line 3, please change “co figured” to -- configured --.
Line 30, please change “farmed” to -- formed --.

Signed and Sealed this

Tenth Day of February, 2004

JON W. DUDAS
*Acting Director of the United States Patent and Trademark Office*